US005362615A

United States Patent [19]

Hagemann et al.

[11] Patent Number: 5,362,615

[45] Date of Patent: Nov. 8, 1994

[54] PHOTOGRAPHIC RECORDING MATERIAL CONTAINING A HYDROQUINONE DIETHER COMPOUND

[75] Inventors: Jörg Hagemann, Cologne; Ralf Weimann, Leverkusen; Erich Wolff, Solingen; Johannes Sobel, Leverkusen, all of Germany

[73] Assignee: Agfa AG, Leverkusen, Germany

[21] Appl. No.: 109,436

[22] Filed: Aug. 20, 1993

[30] Foreign Application Priority Data

Sep. 1, 1992 [DE] Germany ..... 4229132
Jun. 8, 1993 [EP] European Pat. Off. ..... 93109236.5
Jul. 14, 1993 [DE] Germany ..... 4323512

[51] Int. Cl.[5] ..... G03C 1/08; G03C 7/26; G03C 7/32

[52] U.S. Cl. ..... 430/551; 430/372; 430/558; 430/503

[58] Field of Search ..... 430/551, 372, 505, 503, 430/558

[56] References Cited

U.S. PATENT DOCUMENTS 4,631,252 12/1986 Howell ..... 430/551

FOREIGN PATENT DOCUMENTS 54-48538 4/1979 Japan .
54-73032 6/1979 Japan .
1241553 9/1989 Japan .

*Primary Examiner*—Charles L. Bowers, Jr.
*Assistant Examiner*—Geraldine Letscher
*Attorney, Agent, or Firm*—Connolly & Hutz

[57] ABSTRACT

A color-photographic recording material comprising at least one red-sensitive silver halide emulsion layer associated with a cyan coupler, at least one green-sensitive silver halide emulsion layer associated with a magenta coupler, and at least one blue-sensitive silver halide emulsion layer associated with a yellow coupler, at least one layer of the material containing a hydroquinone diether compound having the following formula I and optionally at least one compound having one of the formulae II, III, IV, V, SA and SB given in the description, characterized by increased light stability of the image colorants produced during chromogenic development,

I

In the formula:

$R^1$ denotes alkyl, cycloalkyl or aryl;
$R^2$ denotes H, alkyl;
$R^3$, $R^4$ denote H, alkyl, cycloalkyl, aryl, halogen, alkoxy, aroxy, acyloxy, alkylthio, arylthio, acyl, sulphonyl, sulphamoyl, acylamino, sulphonylamino, nitro;
$R^5$ denotes H, acyl, alkyl;
X denotes —O— or —$NR^6$—;
$R^6$ denotes H or alkyl, and
n denotes O or an integer from 1 to 3.

22 Claims, No Drawings

PHOTOGRAPHIC RECORDING MATERIAL CONTAINING A HYDROQUINONE DIETHER COMPOUND

The invention relates to a photographic recording material comprising at least one silver halide emulsion layer which contains in at least one of its layers light stabilisers in the form of certain hydroquinone diethers.

It is known to produce colored photographic pictures by chromogenic development, i.e. silver halide emulsion layers which have been imagewise exposed are developed in the presence of suitable color couplers by means of suitable color-forming developing substances or "color developers", and the oxidation product of the developer substances, produced in accordance with the silver image, reacts with the color coupler and forms a dye image. The color developers are usually aromatic compounds containing primary amino groups, more particularly p-phenylene diamine type compounds.

It is also known that image dyes produced by chromogenic development suffer certain changes to a varying extent under the influence of environmental conditions. This is particularly striking with regard to the effect of light. As is known, magenta dyes produced from pyrazoloazole couplers are particularly prone to fade, whereas cyan dyes produced from phenolic couplers are particularly insensitive in this respect.

Numerous attempts have been made to obviate this drawback by suitable measures. In the case of the magenta coupler, in particular, light-stabilising additives have been used to improve the resistance to light. The most suitable light-stabilising agents are phenolic compounds, more particularly hydroquinone derivatives, which are either added to the couplers or linked in the form of substituents to the coupler molecules (DE-B-1 547 803, DE-A-26 17 826, DE-A-29 52 511, JP-N 53 070 822, JP-N 54 070 830, JP-N 54 073 032). Hydroquinone dialkyl ethers have also been described as light-excluding agents, e.g. in U.S. Pat. No. 4,588,679 and U.S. Pat. No. 4,735,893. However, the known light-excluding agents do not meet the requirements in all respects.

The aim of the invention is to provide a color photographic recording material containing silver halide emulsion layers with associated cyan, magenta or yellow couplers and stabilised by a light-protecting agent against fading of the chromogenically formed dye under the influence of light.

The invention relates to a color photographic recording material comprising at least one red-sensitive silver halide emulsion layer having associated to it a cyan coupler, at least one green-sensitive silver halide emulsion layer having associated to it a magenta coupler, and at least one blue-sensitive silver halide emulsion layer having associated to it a yellow coupler, the material containing a hydroquinone diether compound in at least one of its layers, characterised in that the hydroquinone diether compound has the following formula I:

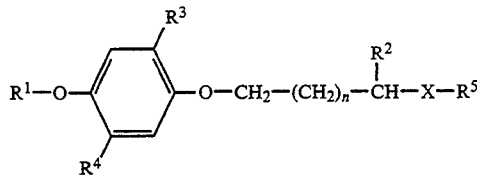

I wherein $R^1$ denotes alkyl, cycloalkyl or aryl, provided that said alkyl is not a propyl group having two or more substiuents;

$R^2$ denotes H, alkyl;

$R^3$, $R^4$ denote H, alkyl, cycloalkyl, aryl, halogen, alkoxy, aroxy, acyloxy, alkylthio, arylthio, acyl, sulphonyl, sulphamoyl, acylamino, sulphonylamino, nitro, provided that said alkoxy denoted by one of $R^3$ and $R^4$ is not a propoxy group having two or more substituents;

$R^5$ denotes H, acyl, alkyl;

X denotes —O— or —$NR^6$—;

$R^6$ denotes H or alkyl, and n denotes O or an integer from 1 to 3.

provided that when n denotes zero and X denotes —O— said alkyl denoted by $R^2$ is not —$CH_2OR^7$ wherein $R^7$ denotes H, alkyl, alkenyl, phenylalkyl, aryl, cycloalkyl, alkylcarbonyl, alkenylcarbonyl or phenylcarbonyl.

An alkyl radical represented by $R^1$ to $R^6$ can be straight-chain or branched, unsubstituted or substituted and contain up to 18 carbon atoms. The following are examples: methyl, ethyl, propyl, isopropyl, butyl, tert.-butyl, tert.-amyl, hexyl, tert.-hexyl, octyl and dodecyl. The substituents can e.g. be halogen, (e.g. chlorine), hydroxy, alkoxy, alkoxycarbonyl or dialkylamino.

Cyclohexyl or cyclopentyl are particular examples of a cycloalkyl radical represented by $R^1$, $R^3$ or $R^4$.

Phenyl, optionally substituted e.g. by alkyl sulphonyl, alkyl and/or alkoxy, is a particular example of an alkyl radical represented by $R^1$, $R^3$ or $R^4$.

An acyl radical represented or contained in $R^3$, $R^4$ or $R^5$ is derived from an aliphatic or aromatic mono- or dicarboxylic acid, a carbonic monoester or a carbamic acid. The following are examples of such acyl radicals: acetyl, 2-ethyl hexanoyl, p-hydroxybenzoyl, N-n-butyl carbamoyl, N-t-butyl carbamoyl, N-dodecyl carbamoyl, hexyloxy carbonyl or dodecyloxy carbonyl. An acyl radical represented by $R^5$ can also be derived from phosphoric acid, phosphonic acid or phosphorous acid.

In a preferred embodiment of the invention, the hydroquinone diether compound corresponds to formula I, in which at least one of the radicals $R^3$ and $R^4$ stands for tertiary alkyl.

In another preferred embodiment of the invention, the hydroquinone diether compound corresponds to formula I, in which —X—$R^5$ stands for —OH, —O—$CH_2CH_2$—OH or —O—acyl, and the acyl radical is derived from aliphatic or aromatic carboxylic acids, carbamic acids, carbonic monoesters or phosphoric acid, phosphonic acid or phosphorous acid.

In other preferred embodiments of the invention, the hydroquinone diether compound corresponds to formula I, where n stands for 0 or 1.

The following are examples of hydroquinone diether compounds according to the invention.

I-1
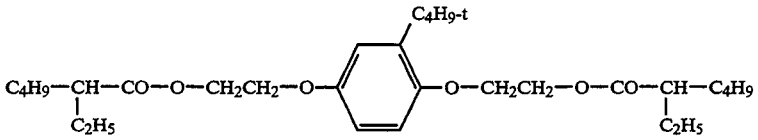
I-2
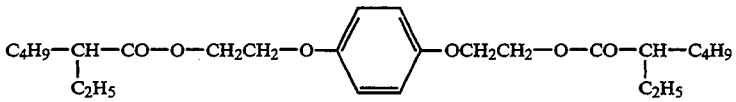
I-3
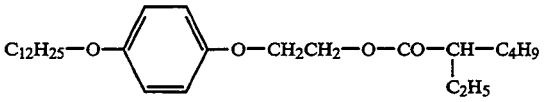
I-4
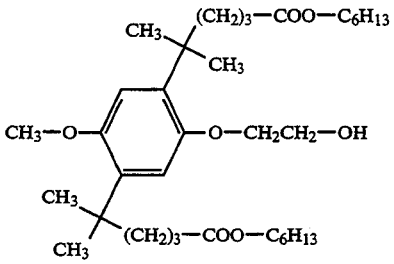
I-5
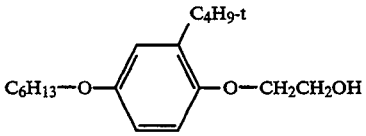
I-6
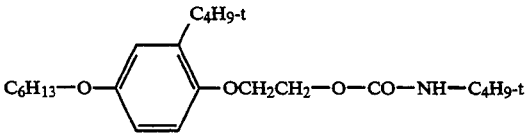
I-8
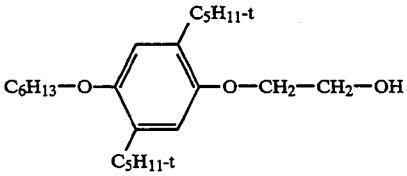
I-9
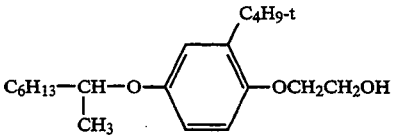
I-10
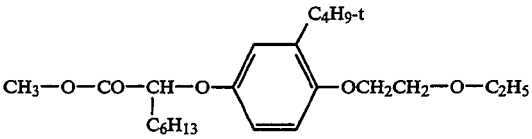
I-11
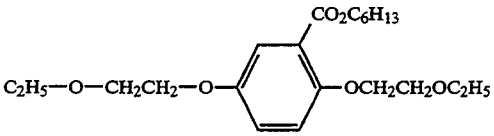
I-12
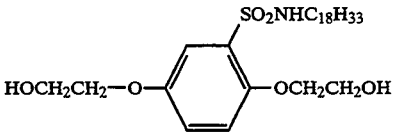
I-13
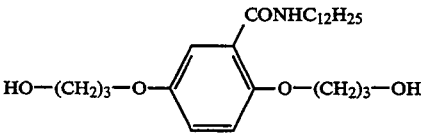
I-14
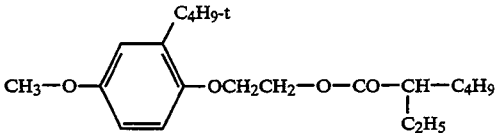
I-15
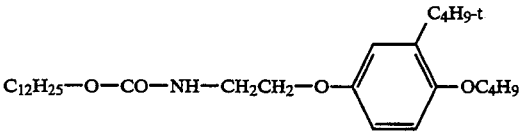
I-16
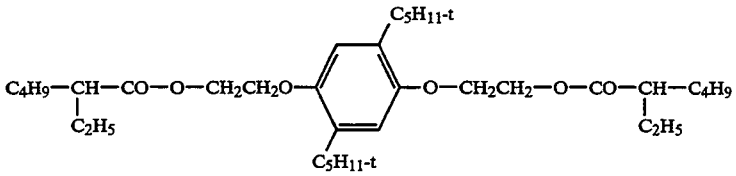

-continued
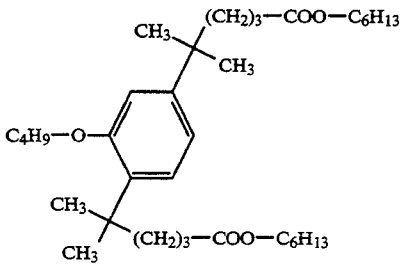
I-17
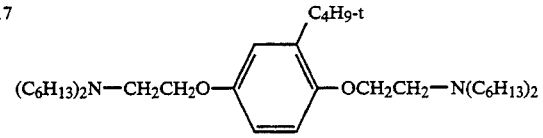
I-18
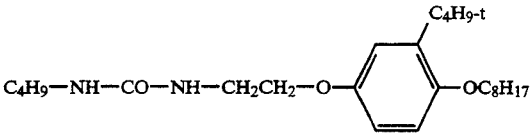
I-19
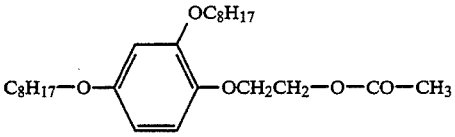
I-20
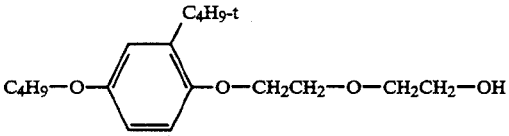
I-21
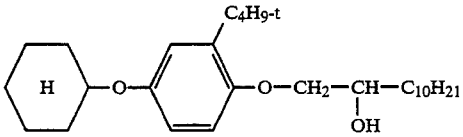
I-22
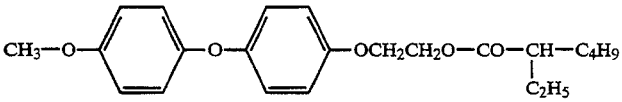
I-23
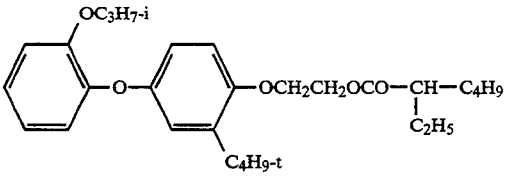
I-24
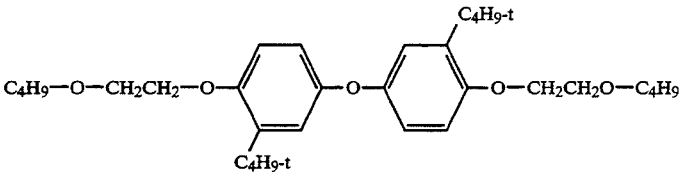
I-25
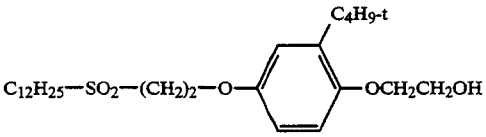
I-26
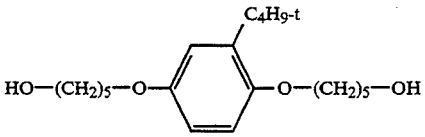
I-27
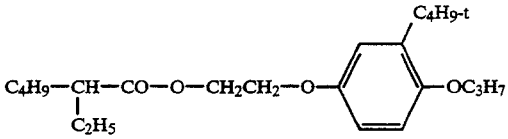
I-28
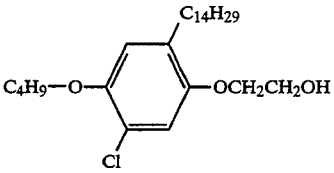
I-29
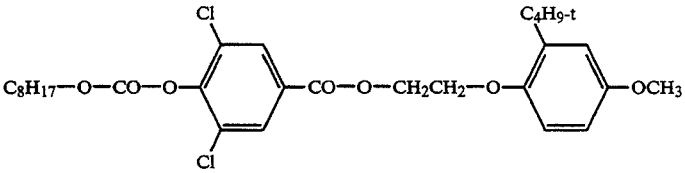
I-30

-continued

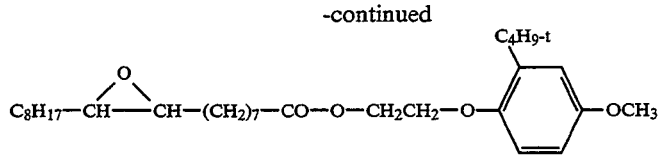

I-31

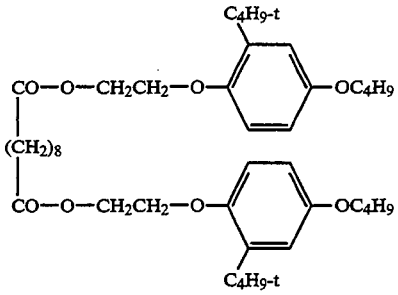

I-32

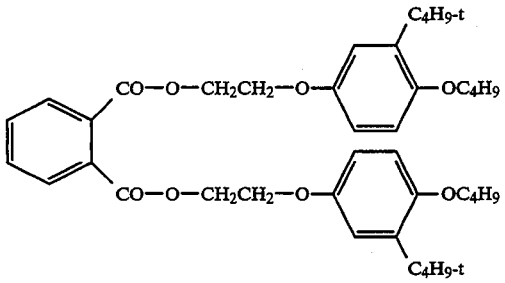

I-33

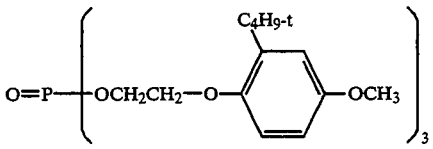

I-34

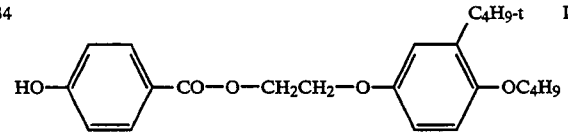

I-35

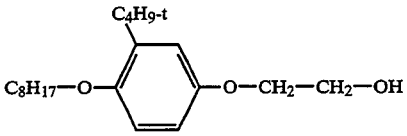

I-36

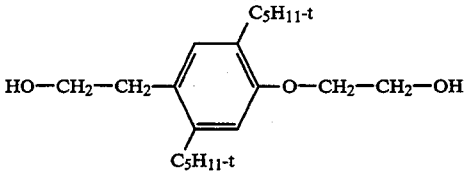

I-37

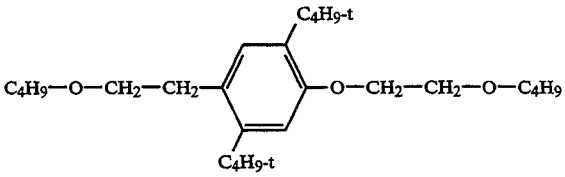

I-38

EXAMPLE OF SYNTHESIS

Synthesis of the light-excluding agent I-14

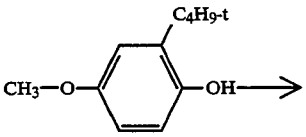

1

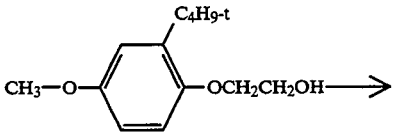

2

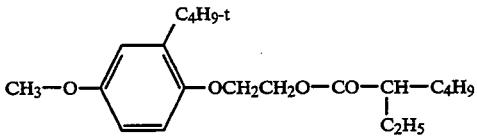

Light-excluding agent I-14

18.0 g (100 mmol) of 3-tert.butyl-4-hydroxyanisole (compound 1) were heated in 25.0 g ethylene carbonate to 120° C. 5.0 g of potassium carbonate was added in portions and agitated at the same temperature for 4 hours. The reaction mixture was poured into water, dissolved in ether, washed with water, dried over sodium sulphate and concentrated in a rotary evaporator. Purification by column chromatography over silica gel yielded 16.4 g (75% of the theoretical) of compound 2.

16.4 g (73.1 mmol) of compound 2, 11.0 g (76.3 mmol) of 2-ethylhexanoic acid and 0.5 g of p-toluenesulphonic acid were heated in 50 ml toluene on a water separator for 6 hours. The organic phase was then washed to neutrality with sodium hydrogen carbonate solution and water, dried over sodium sulphate and concentrated in a rotary evaporator. Purification by column chromatography over silica gel yielded 22.0 g (86% of the theoretical) of I-14.

It has been shown that the light-stabilising effect obtained with formula I compounds can be increased to a further appreciable extent if a formula I compound is used in combination with at least one compound having one of the following formulae II, III, IV, V, SA and SB:

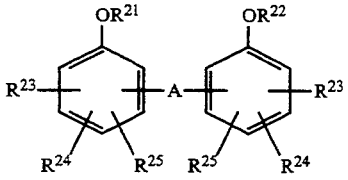

(II)

wherein $R^{21}$, $R^{22}$ denote radicals such as $R^5$;

$R^{23}$, $R^{24}$, $R^{25}$ denote radicals such as $R^3$;

A denotes a single bond, $-S(=O)_m-$, alkylene or $-NR^{26}-$;

$R^{26}$ denotes alkyl or acyl;

m=0, 1 or 2;

wherein A is preferably bonded to a position ortho or para to $-OR^{21}$ and $-OR^{22}$ and wherein when A is not bonded to the para position a residue which is not releasable during chromogenic development ($R^{23}$, $R^{24}$, $R^{25}$) is bonded to the para position,

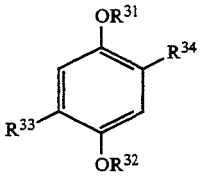

(III)

wherein $R^{31}$, $R^{32}$ denote alkyl or cycloalkyl;

$R^{33}$, $R^{34}$ denote radicals such as $R^3$;

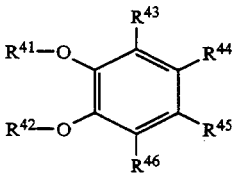

(IV)

wherein $R^{41}$, $R^{42}$ denote radicals such as $R^5$;

$R^{43}$, $R^{44}$, $R^{45}$, $R^{46}$ denote radicals such as $R^3$, provided that at least one of the radicals $R^{44}$ and $R^{45}$ does not denote alkyl;

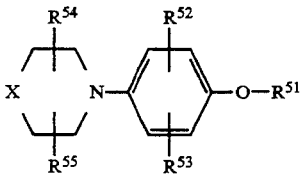

(V)

wherein $R^{51}$ denotes alkyl, cycloalkyl or aryl;

$R^{52}$, $R^{53}$, $R^{54}$, $R^{55}$ denote radicals such as $R^3$;

X denotes $-\overset{R^{56}}{\overset{|}{C}}H-$, $-CO-$, $-O-$, $-S-$,

-continued $-SO-$, $SO_2-$, $-\overset{R^{57}}{\overset{|}{N}}-$;

$R^{56}$ denotes a radical such as $R^3$;

$R^{57}$ alkyl, aryl, acyl, sulfonyl;

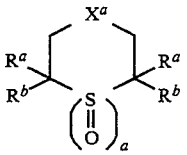

(SA)

wherein $R^a$, $R^b$ denotes H, alkyl, aryl;

a=0, 1 or 2;

$X^a$ denotes a residue for completing a tetrahydrothiapyrane ring provided that $R^a$ and $R^b$ may complete a ring;

$R^c-S-D-X^b-R^d$ (SB)

wherein $R^c$, $R^d$ denote alkyl, aryl

D denotes alkylene having 1 to 16 carbon atoms, preferably 1 to 12 carbon atoms;

$X^b$ denotes $-CO-O-$, $-O-CO-$, $-CO-NH-$, $-NH-CO-$.

An alkyl radical denoted by $R^{26}$, $R^{51}$, $R^{57}$, $R^a$, $R^b$, $R^c$ and $R^d$ is an alkyl radical such as one of $R^1$ to $R^6$. An alkyl radical denoted by one of $R^c$ and $R^d$ may be substituted, for example, with aryl, acyloxy, alkylthio or alkoxycarbonyl. An alkyl radical denoted by $R^{31}$ or $R^{32}$ can be straight-chain or branched and contain up to 18 carbon atoms.

A cycloalkyl radical denoted by $R^{31}$, $R^{32}$ or $R^{51}$ is a cycloalkyl radical such as may also be denoted by one of $R^1$, $R^3$ and $R^4$.

An aryl radical denoted by one of $R^{51}$, $R^{57}$, $R^a$, $R^b$, $R^c$ and $R^d$ is one as may also be denoted by one of $R^1$, $R^3$ and $R^4$.

An acyl radical denoted by one of $R^{26}$ and $R^{57}$ is one as may also be denoted by one of $R^3$, $R^4$ and $R^5$.

The compounds of formula II correspond, for example, to one of the general formulae IIA and IIB

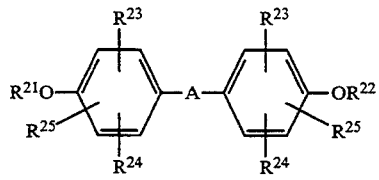

(II A)

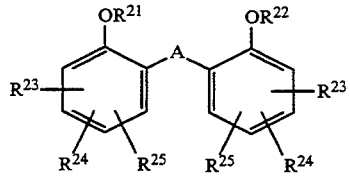

(II B)

wherein A and $R^{21}$ to $R^{25}$ have the meaning defined above and wherein $R^{27}$ stands for alkyl or alkoxycarbonyl.

In a preferred embodiment of the invention, in formula II: A stands for alkylene with 1-6 carbon atoms or for $-S(=O)_m-$ with m=0, 1 or 2; $R^{21}$ and $R^{22}$ stand for H;

in formula III: at least one of the radicals $R^{33}$ and $R^{34}$ stand for alkyl;

in formula IV: $R^{41}$ and $R^{42}$ stand for H or alkyl;

in formula V: $R^{54}$ and $R^{55}$ stand for H.

The following are examples of formula II, III, IV, V, SA and SB compounds used according to the invention:

II-1

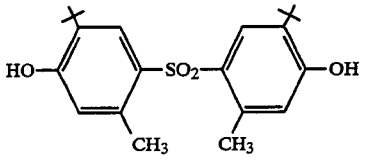

II-2

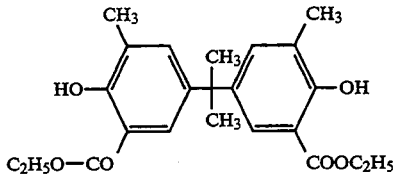

II-3

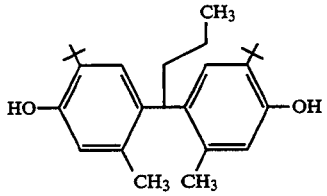

II-4

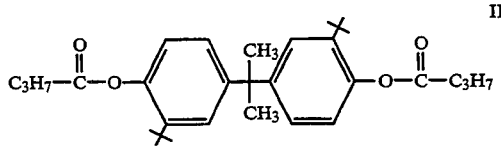

II-5

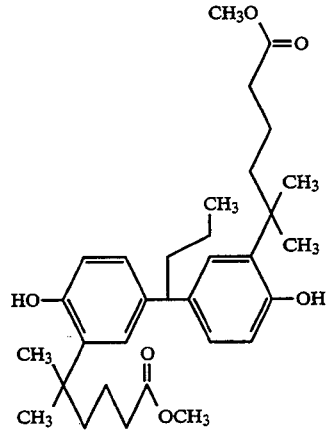

II-6

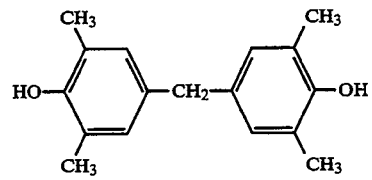

-continued

II-7

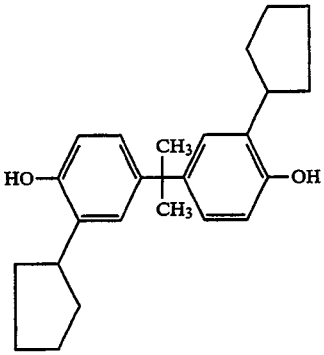

II-8

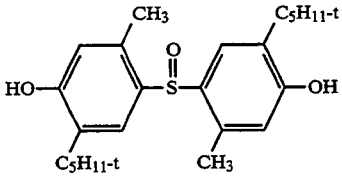

II-9

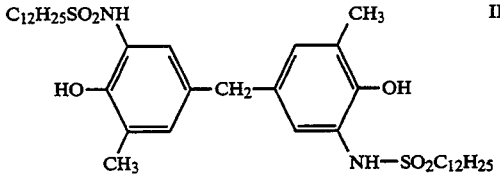

II-10

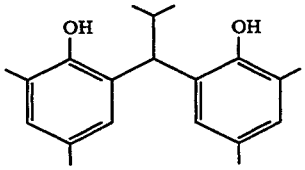

II-11

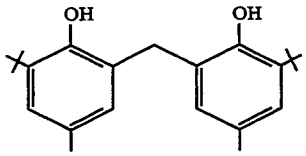

II-12

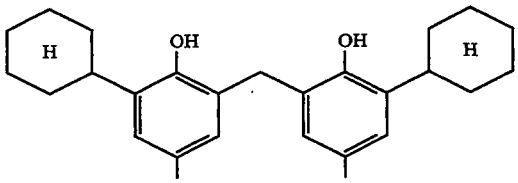

II-13

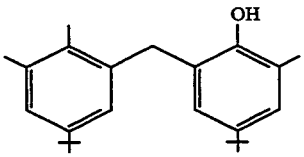

II-14

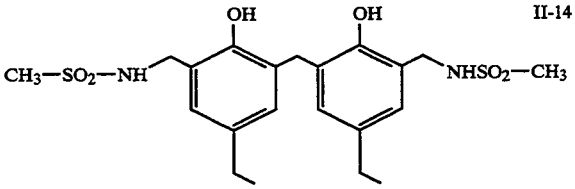

-continued
II-15
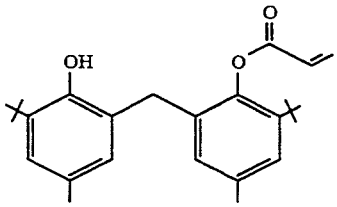
II-16
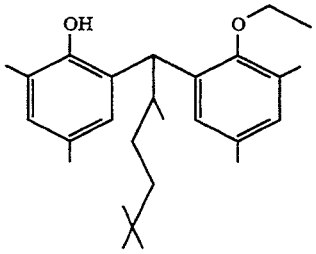
II-17
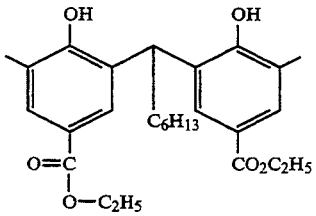
III-1
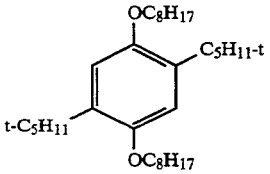
III-2
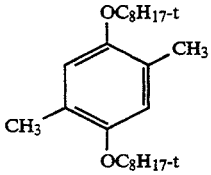
III-3
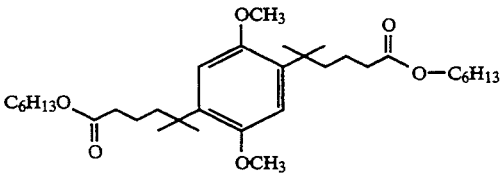
III-4
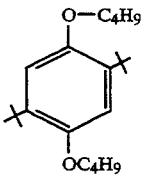
III-5
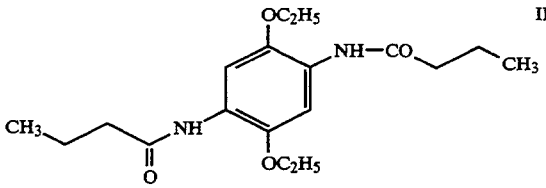
-continued
III-6
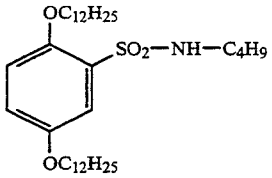
III-7
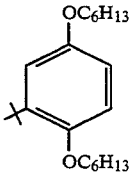
III-8
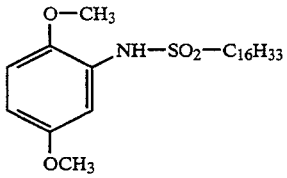
III-9
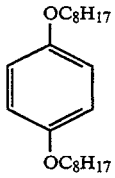
IV-1
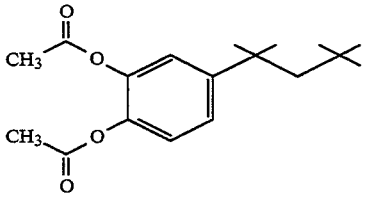
IV-2
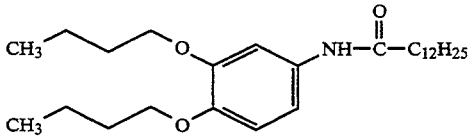
IV-3
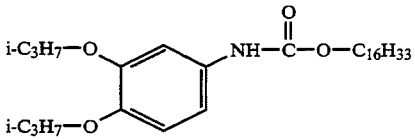
IV-4
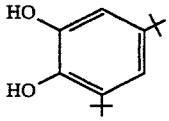
IV-5
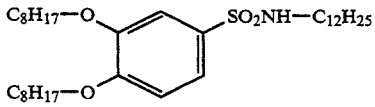

-continued
IV-6
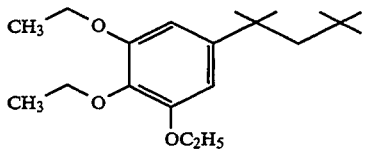
IV-7
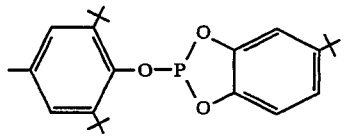
IV-8
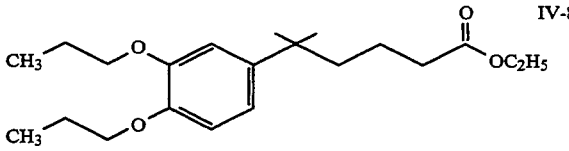
V-1
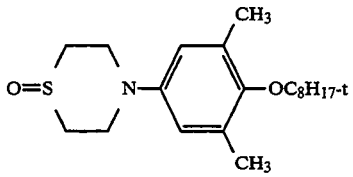
V-2
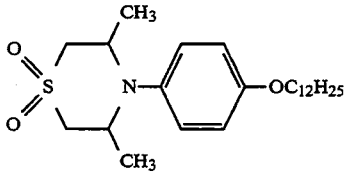
IV-3
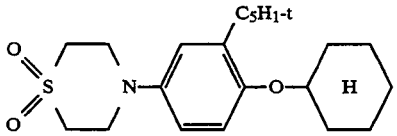
V-4
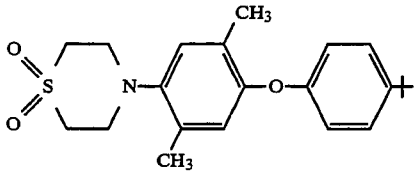
V-5
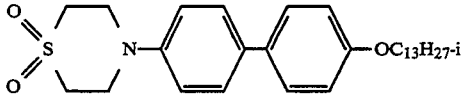
V-6
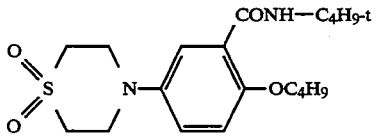
V-7
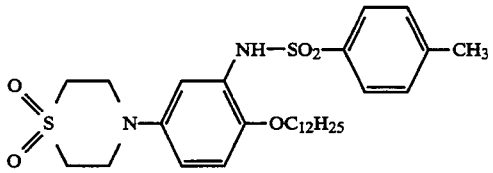
-continued
V-8
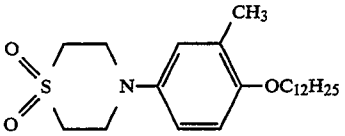
V-9
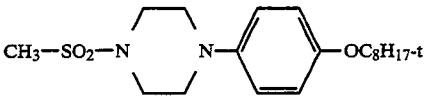
V-10
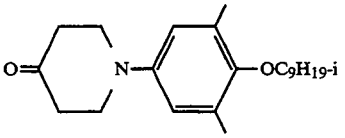
V-11
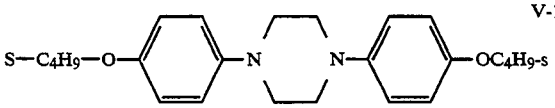
V-12
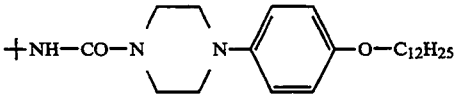
V-13
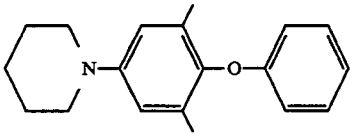
V-14
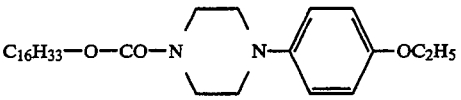
V-15
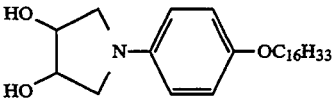
V-16
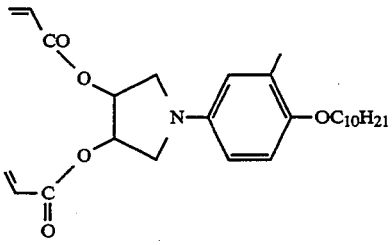
(SA-1)
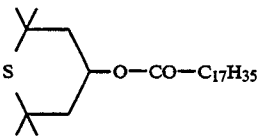

-continued (SA-2)

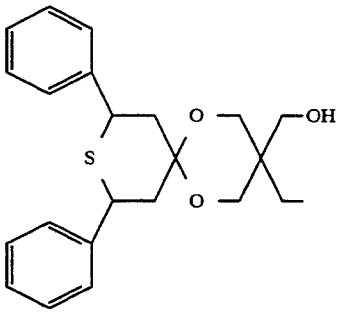

(SA-3)

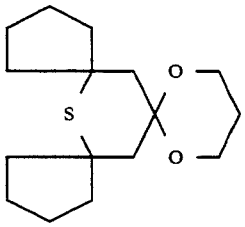

(SA-4)

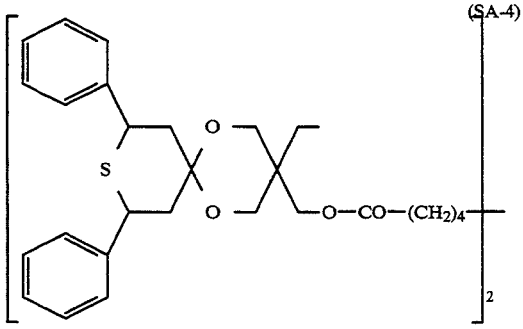

(SA-5)

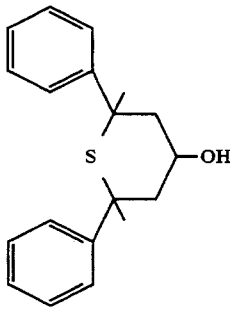

(SA-6)

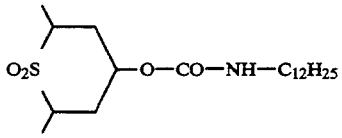

-continued (SA-7)

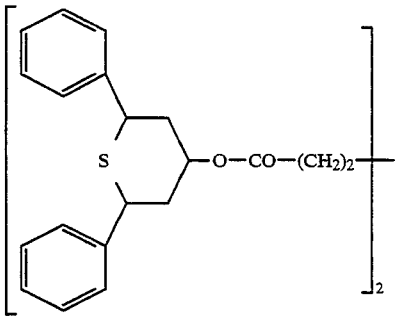

(SA-8)

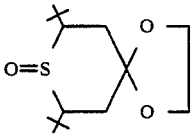

(SA-9)

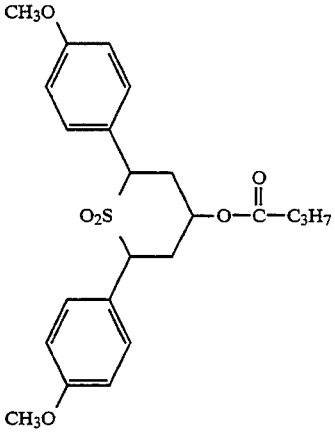

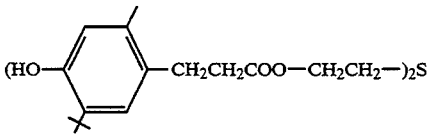

The color photographic recording material according to the invention contains a sequence of a number of photosensitive silver halide emulsion layers with respective associated dye couplers and optionally other auxiliary layers, more particularly protective layers and non-photosensitive binder layers between the photosensitive layers. According to the invention, at least one of the photosensitive silver halide emulsion layers is associated with a formula I compound according to the invention in combination with a color coupler. Preferably a formula I compound according to the invention is combined with at least one compound having one of the formulae II, III, IV, V, SA or SB. This results in synergic effects, i.e. the azomethine dyes produced during development are protected from light by a combination of a formula I compound and a compound having one of the formulae II, III, IV, V, SA and SB better than by a formula I compound alone. The formula I compounds are used with compounds having one of the formulae II, III, IV, V, SA and SB in a proportion of 1:10 to 10:1, preferably 1:4 to 4:1.

The formula I, II, III, IV, V, SA and SB compounds used according to the invention act mainly as light-stabilising agents, i.e. in their presence the azomethine dyes formed from the color coupler during chromogenic development have much greater stability against the action of light. Also, the compounds according to the invention take over some or all the functions of an oil-forming agent for the color coupler, i.e. they can be used alone or together with other known oil-forming agents as solvents for the coupler. The compounds according to the invention preferably make up 50 to 100% by weight of the total amount of oil-forming agent in the respective layer. Preferably therefore they are used in a proportion of 0.2 to 2 by weight, relative to the color coupler used with them. The fact that other oil-forming agents are required only in smaller quantities, if at all, advantageously affects the stress on the layer and/or the total layer thickness of the recording materials according to the invention.

The formula I to V compounds used according to the invention, in the form of a solution in aprotic (hydrophobic) solvents such as ethyl acetate, are used together with the respective color coupler when incorporated in the solution for casting the respective layer. Incorporation is brought about in conventional manner, optionally with additional auxiliary solvents and/or high-boiling coupler solvents or "oil-forming agents".

In the silver halide, the photosensitive component of the photographic recording material according to the invention, i.e. the halide, can be chloride, bromide, iodide or mixtures thereof. For example, the halide component can consist of at least one layer of 0 to 15 mol. % iodide, 0 to 100 mol. % chloride and 0 to 100 mol. % bromide.

Silver bromide-iodide emulsions are normally used in the case of color-negative and color-reversal films, whereas in the case of color-negative and color-reversal paper, it is normal to use silver chloride-bromide emulsions with a high chloride content, up to pure silver chloride emulsions. The crystals can be mainly compact, i.e. regular cubic or octahedral or transitional forms. Preferably also the crystals can be plate-like, the average ratio of diameter to thickness preferably being at least 5:1, the diameter of a grain being defined as the diameter of a circle having an area equal to the projected area of the grain. Alternatively the layers can comprise tabular silver halide crystals, where the ratio of diameter to thickness is considerably greater than 5:1, e.g. 12:1 to 30:1.

The silver halide grains can also have a multi-layer structure. In the simplest case they can have an inner and an outer grain region (core/shell), with variations in halide composition and/or other modifications such as doping of the individual grain regions. The average grain size of the emulsions is preferably between 0.2 μm and 2.0 μm. The grain size distribution can be either homo- or hetero-dispersed. "Homo-dispersed" grain size distribution means that 95% of the grains do not differ by more than ±30% from the average grain size.

In addition to the silver halide, the emulsions can contain other silver salts, e.g. organic silver salts such as silver benzotriazolate or silver behenate.

Two or more kinds of separately-produced silver halide emulsion can be used as a mixture.

The emulsions can be chemically and/or spectrally sensitised in conventional manner; they can also be stabilised by suitable additives. Suitable chemical sensitisers, spectral sensitising dyes and stabilisers are described e.g. in Research Disclosure 17643 (December 1978); see particularly Chapters III, IV and VI.

The color-photographic recording material according to the invention contains at least one red-sensitive, at least one green-sensitive and at least one blue-sensitive silver halide emulsion layer. In order to adjust the sensitivity, the photosensitive layers are spectrally sensitised in known manner by suitable sensitising dyes. It may not be necessary to add sensitising dyes to the blue-sensitive silver halide emulsion layer, owing to its existing or natural sensitivity.

A general view of polymethine dyes suitable as spectral sensitisers, suitable combinations thereof and supersensitising combinations is given in Research Disclosure 17643 (December 1978), Chapter IV.

The green sensitisers can e.g. be 9-ethyl carbocyanines with benzoxasole, or naphthoxazole or a benzoxazole and a benzothiozole as basic terminal groups or benzimidazo carbocyanines, which can likewise be additionally substituted and likewise must contain at least one sulphoalkyl group on the heterocyclic nitrogen.

The following are examples of green sensitisers GS, each being usable alone or in combination, e.g. GS-1 and GS-2

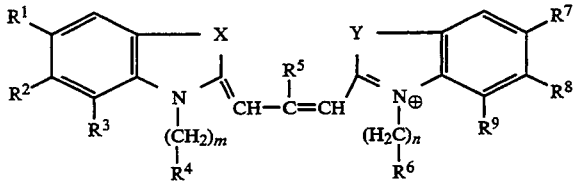

GS-1: $R^1$, $R^3$, $R^7$, $R^9$=H; $R^2$=Phenyl;

$$R^4 = -\underset{\underset{CH_3}{|}}{CH}-SO_3\ominus\overset{\oplus}{N}H(C_2H_5)_3;$$

$R^5$=—$C_2H_5$; $R^6$=—$SO_3\ominus$; $R^8$=Cl; m=2; n=3; X, Y=O;

GS-2: $R^1$, $R^2$, $R^7$, $R^8$=Cl; $R^3$, $R^5$, $R^6$, $R^9$=H;

$$R^4 = -\underset{\underset{CH_3}{|}}{CH}-SO_3\ominus;\ m,$$

n=2; X, Y=N—$C_2H_5$;

GS-3: $R^1$, $R^7$=H; $R^2$, $R^3$ and $R^8$, $R^9$ together denote —CH=CH—CH=CH—; $R^4$=$SO_3\ominus Na\oplus$; $R^5$=$C_2H_5$; $R^6$=$SO_3\ominus$; m, n=3; X, Y=0;

GS-4: $R^1$, $R^3$, $R^4$, $R^7$, $R^8$, $R^9$=H; $R^2$=—$OCH_3$; $R^5$=—$C_2H_5$; $R^6$=$SO_3\ominus$; m=2; n=4; X=0, Y=S.

Each of the aforementioned photosensitive layers can consist of a single layer or in known manner, e.g. in the "double-layer arrangement", can comprise two or more silver halide emulsion component layers (DE-C-1 121 470). In the case of negative films, usually red-sensitive silver halide emulsion layers are disposed nearer the layer support than green-sensitive silver halide emulsion layers, which in turn are placed nearer than blue-sensitive, and usually a non-photosensitive yellow filter layer is disposed between green-sensitive layers and blue-sensitive layers. Other arrangements, however, are possible, e.g. in the case of colour paper. Usually a non-photosensitive intermediate layer is disposed between layers differing in spectral sensitivity, and can contain means for preventing faulty diffusion of developer oxidation products. If other silver halide emulsion layers having the same spectral sensitivity are present, they can either be disposed adjacent one another or so that a photosensitive layer having different spectral sensitivity is between them (DE-A-1 958 709, DE-A-2 530 645, DE-A-2 622 922).

Color photographic recording materials according to the invention usually contain color couplers of varying spectral sensitivity, in spatial and spectral association with the silver halide emulsion layers, for producing the various cyan, magenta and yellow component color images, at least one color coupler together with one of the formula I compounds according to the invention, preferably in combination with at least one compound having one of the formulae II, III, IV, V, SA and SB being associated with the respective silver halide emulsion layer.

"Spatial association" means that the color couplers are in a spatial relation to the silver halide emulsion layer such that interaction between them is possible, so as to permit an agreement corresponding to the picture between the silver image formed during development and the color image generated by the color coupler. To this end, as a rule, the color coupler together with the formula I hydroquinone diether compound, preferably in combination with at least one compound of formula II, III, IV, V, SA and SB is present in the silver halide emulsion layer itself or in an adjacent, optionally non-photosensitive binder layer.

"Spectral association" means that the spectral sensitivity of each of the photosensitive silver halide emulsion layers and the color of the component color image generated by the respective spatially associated color coupler are in a certain relation to one another, each of the spectral sensitivities (red, green, blue) being associated with a different color in the respective component color image (usually e.g. the colors cyan, magenta and yellow in that sequence).

Color couplers for producing the cyan component color image are usually phenol or α-naphthol type couplers; the following are suitable examples:

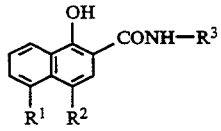

C-1: $R^1$, $R^2$ = H; $R^3$ = $-(CH_2)_3-O-$ 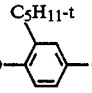 $-C_5H_{11}$-t

C-2: $R^1$ = $-NHCOOCH_2-CH(CH_3)_2$; $R^2$ = H;
$R^3$ = $-(CH_2)_3-OC_{12}H_{25}$

C-3: $R^1$ = H; $R^2$ = $-OCH_2-CH_2-SO_2CH_3$;
$R^3$ = $-C_{16}H_{33}$

C-4: $R^1$ = H; $R^2$ = $-OCH_2-CONH-(CH_2)_2-OCH_3$;

$R^3$ = $-(CH_2)_4-O-$ 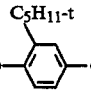 $-C_5H_{11}$-t

-continued

C-5: $R^1$, $R^2$ = H; $R^3$ = $-(CH_2)_4-O-$ 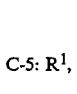 $-C_5H_{11}$-t

C-6: $R^1$, $R^2$ = H; $R^3$ = $-(CH_2)_4-O-$ 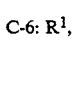 $-C_4H_9$-t

C-7: $R^1$ = H; $R^2$ = Cl; $R^3$ = $-C(C_2H_5)_2-C_{21}H_{43}$

C-8 $R^1$ = H;
$R^2$ = $-O-CH_2-CH_2-S-CH(COOH)-C_{12}H_{25}$
$R^3$ = Cyclohexyl

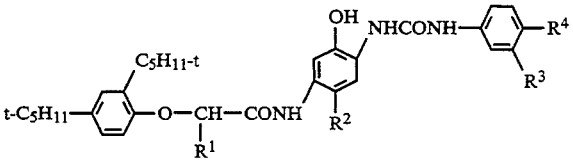

C-9: $R^1$ = $-C_4H_9$; $R^2$ = H; $R^3$ = $-CN$; $R^4$ = Cl

C-10: $R^1$ = $-C_4H_9$; $R^2$ = H; $R^3$ = H; $R^4$ = $-SO_2CHF_2$

C-11: $R^1$ = $-C_4H_9$;
$R^2$ = $-O-$ 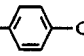 $-C(CH_3)_2-CH_2-C(CH_3)_3$;
$R^3$ = H; $R^4$ = $-CN$

C-12: $R^1$ = $C_2H_5$; $R^2$, $R^3$ = H; $R^4$ = $-SO_2CH_3$

C-13: $R^1$ = $-C_4H_9$; $R^2$, $R^3$ = H; $R^4$ = $-SO_2-C_4H_9$

C-14: $R^1$ = $-C_4H_9$; $R^2$ = H; $R^3$ = $-CN$; $R^4$ = $-CN$

C-15: $R^1$ = $-C_4H_9$; $R^2$, $R^3$ = H;
$R^4$ = $-SO_2-CH_2-CHF_2$

C-16: $R^1$ = $-C_2H_5$; $R^2$, $R^3$ = H;
$R^4$ = $-SO_2CH_2-CHF-C_3H_7$

C-17: $R^1$ = $-C_4H_9$; $R^2$, $R^3$ = H; $R^4$ = F

C-18: $R^1$ = $-C_4H_9$; $R^2$, $R^3$ = H; $R^4$ = $-SO_2CH_3$

C-19: $R^1$ = $-C_4H_9$; $R^2$, $R^3$ = H; $R^4$ = $-CN$

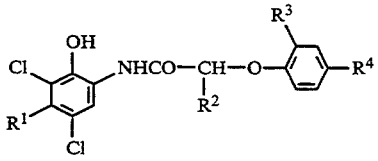

C-20: $R^1$ = $-CH_3$; $R^2$ = $-C_2H_5$; $R^3$, $R^4$ = $-C_5H_{11}$-t

C-21: $R^1$ = $-CH_3$; $R^2$ = H; $R^3$, $R^4$ = $-C_5H_{11}$-t

C-22: $R^1$, $R^2$ = $-C_2H_5$; $R^3$, $R^4$ = $-C_5H_{11}$-t

C-23: $R^1$ = $-C_2H_5$; $R^2$ = $-C_4H_9$; $R^3$, $R^4$ = $-C_5H_{11}$-t

C-24: $R^1$ = $-C_2H_5$; $R^2$ = $-C_4H_9$; $R^3$, $R^4$ = $-C_4H_9$-t

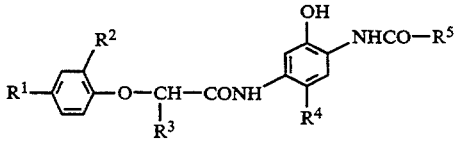

-continued

C-25: $R^1$, $R^2$ = $-C_5H_{11}$-t; $R^3$ = $-C_4H_9$; $R^4$ = H; $R^5$ = $-C_3F_7$

C-26: $R^1$ = $-NHSO_2-C_4H_9$; $R^2$ = H; $R^3$ = $-C_{12}H_{25}$; $R^4$ = Cl; $R^5$ = Phenyl C-27: $R^1$, $R^2$ = $-C_5H_{11}$-t; $R^3$ = $-C_3H_7$-i; $R^4$ = Cl; $R^5$ = Pentafluorophenyl C-28: $R^1$ = $-C_5H_{11}$-t; $R^2$ = Cl; $R^3$ = $-C_6H_{13}$; $R^4$ = Cl; $R^5$ = -2-Chlorophenyl Color couplers for producing the magenta component color image are usually of the same type as 5-pyrazolone, indazolone or pyrazoloazoles; the following are suitable examples:

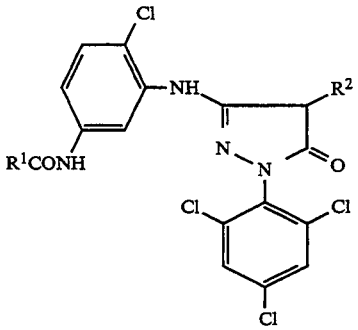

M-1: $R^1$ = 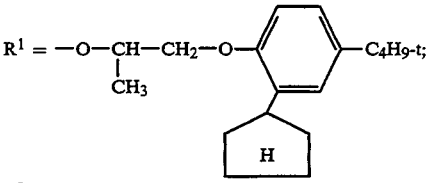

$R^2$ = H

M-2: $R^1$ = 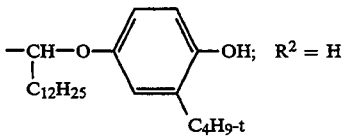 $R^2$ = H

M-3: $R^1$ = $-C_{13}H_{27}$; $R^2$ = H

M-4: $R^1$ = $-OC_{16}H_{33}$; $R^2$ = H

M-5: $R^1$ = $-C_{13}H_{27}$; $R^2$ = 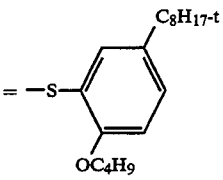

M-6: $R^1$ = 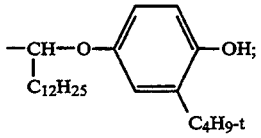

-continued $R^2$ = 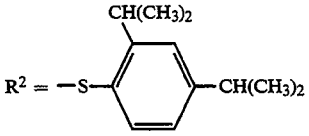

M-7: $R^1$ = $-C_9H_{19}$;

$R^2$ = 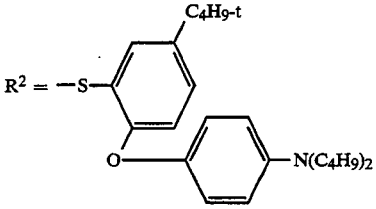

M-8: $R^1$ = 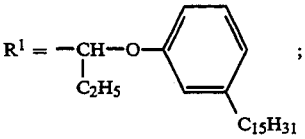 ;

$R^2$ = 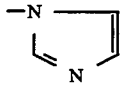

M-9: 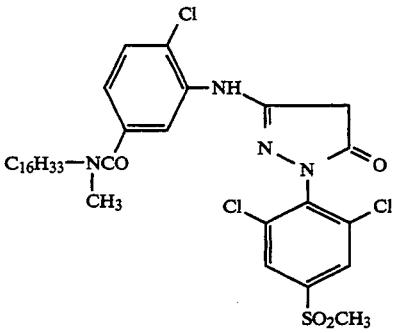

M-10: 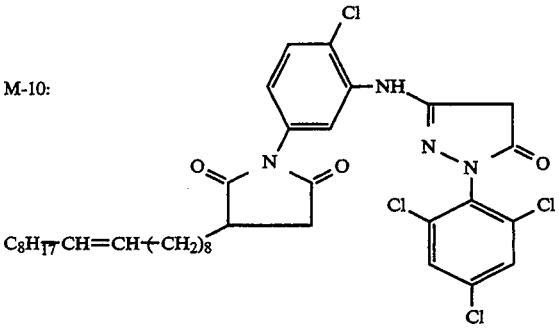

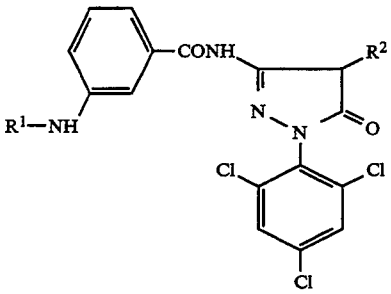

-continued

M-11: $R^1 = -SO_2-$ 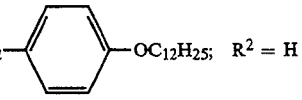 $-OC_{12}H_{25}$; $R^2 = H$

M-12: $R^1 = -CO-CH_2-O-$ 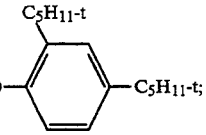 $-C_5H_{11}$-t;

$R^2 = H$

M-13: $R^1 = -CO-CH(C_2H_5)-O-$ 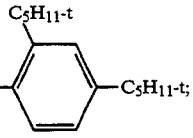 $-C_5H_{11}$-t;

$R^2 = H$

M-14: $R^1 = -CO-CH(C_2H_5)-O-$ 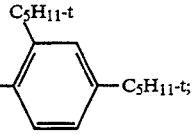 $-C_5H_{11}$-t;

$R^2 = -O-$ 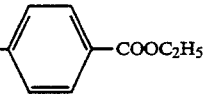 $-COOC_2H_5$

M-15: $C_{17}H_{35}CONH-$ 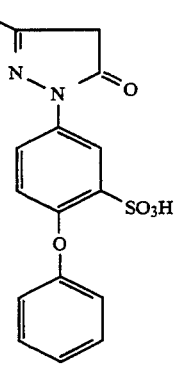

M-16: 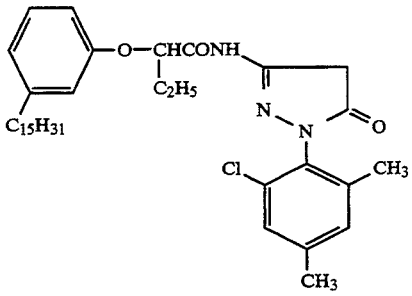

-continued

M-17: $t\text{-}C_4H_9CONH-$ 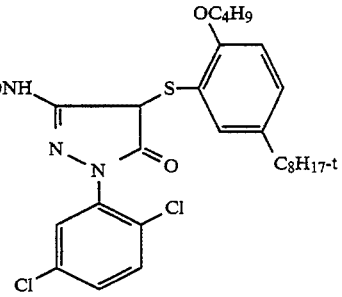

Color couplers for producing the yellow component color image usually have an open-chain ketomethylene grouping, more particularly of the same type as α-acyl acetamide, e.g. α-benzoyl acetanilide couplers and α-pivaloyl acetanilide couplers having the formulae:

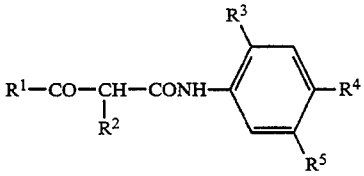

Y-1: $R^1 = -C_4H_9$-t;

$R^2 =$ 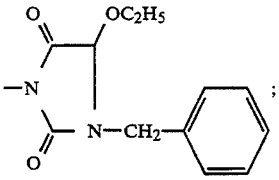 ;

$R^3 = Cl$; $R^4 = H$;

$R^5 =$ 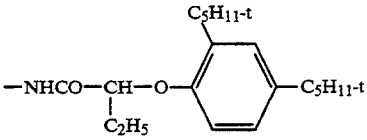

Y-2: $R^1 = -C_4H_9$-t; $R^2 =$ 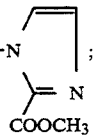 ;

$R^3 = -OC_{16}H_{33}$; $R^4 = H$;

$R^5 = -SO_2NHCH_3$

Y-3: $R^1 = -C_4H_9$-t;

$R^2 =$ 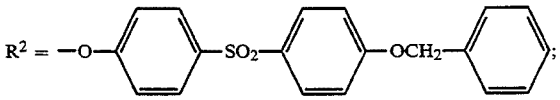 ;

$R^3 = Cl$ $R^4 = H$;

$R^5 = -NHSO_2-C_{16}H_{33}$

Y-4: $R^1 = -C_4H_9$-t;

-continued

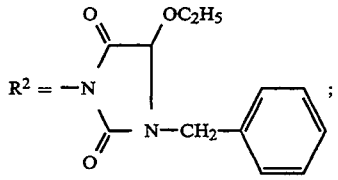

$R^3$ = Cl; $R^4$ = H; $R^5$ = $-COOC_{12}H_{25}$

Y-5: $R^1$ = $-C_4H_9$-t;

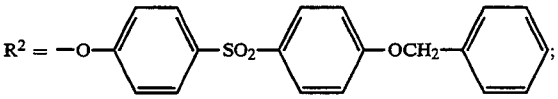

$R^3$ = Cl; $R^4$ = H;

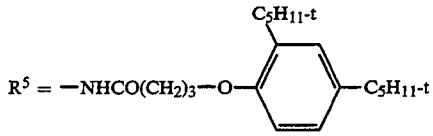

Y-6: $R^1$ = $-C_4H_9$-t;

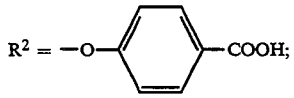

$R^3$ = Cl; $R^4$ = H;

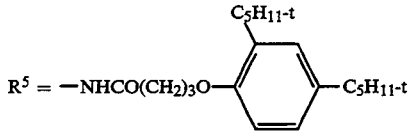

Y-7: $R^1$ = $-C_4H_9$-t;

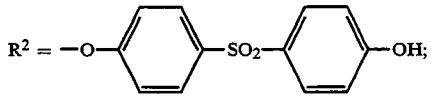

$R^3$ = Cl; $R^4$ = H; $R^5$ = $-NHSO_2-C_{16}H_{33}$

Y-8: $R^1$ = $-C_4H_9$-t; $R^2$ =

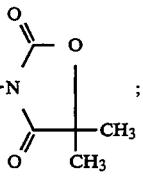

;

$R^3$ = Cl; $R^4$ = H;

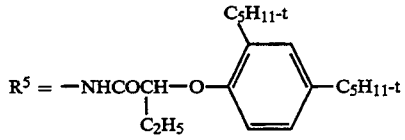

Y-9: $R^1$ = $-C_4H_9$-t;

-continued

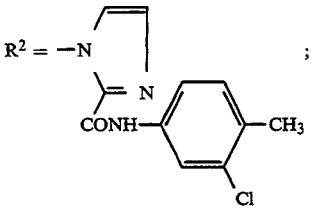

;

$R^3$ = $-OC_{16}H_{33}$; $R^4$ = H;

$R^5$ = $-SO_2NHCOC_2H_5$

Y-10: $R^1$ = $-C_4H_9$-t;

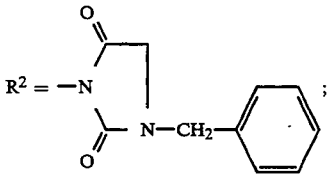

;

$R^3$ = Cl; $R^4$ = H

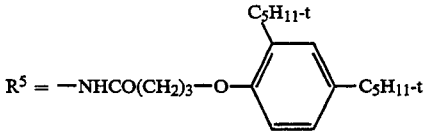

Y-11: $R^1$ = $-C_4H_9$-t; $R^2$ =

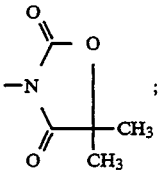

;

$R^3$ = Cl; $R^4$ = H;

$R^5$ = $-COOCH(C_4H_9)-COOC_{12}H_{25}$

Y-12: $R^1$ = $-C_4H_9$-t; $R^2$ =

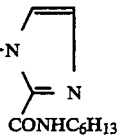

;

$R^3$ = Cl; $R^4$ = H

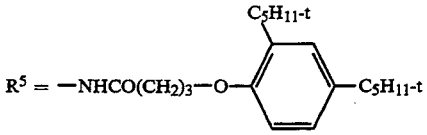

Y-13: $R^1$ = $-C_4H_9$-t; $R^2$ =

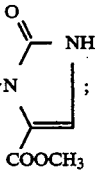

;

$R^3$ = $-OC_{16}H_{33}$; $R^4$ = H; $R^5$ = $-SO_2NHCH_3$

-continued

Y-14: $R^1 = -C_4H_9\text{-}t$; $R^2 =$ 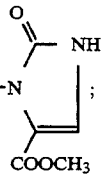 ;

$R^3 = Cl$; $R^4 = H$;

$R^5 =$ 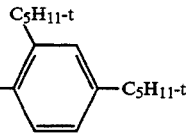

Y-15: $R^1 = t\text{-}C_5H_{11}$ 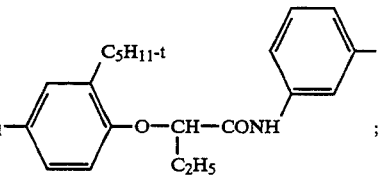 ;

$R^2, R^4, R^5 = H$; $R^3 = -OCH_3$

Y-16: $R^1 =$ 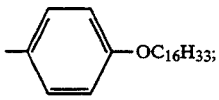

$R^2 =$ 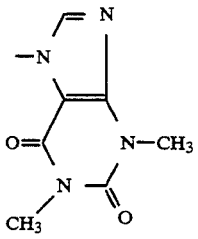

$R^3, R^5 = -OCH_3$; $R^4 = H$

Y-17: $R^1 =$ 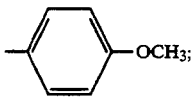

$R^2 =$ 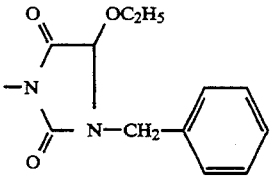

$R^3 = Cl$; $R^4 = H$; $R^5 = -COOC_{12}H_{25}$

Y-18: $R^1 =$ 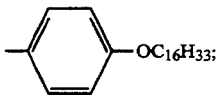

-continued $R^2 =$ 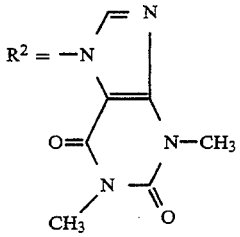

$R^3 = Cl$; $R^4, R^5 = -OCH_3$

Y-19: $R^1 =$ 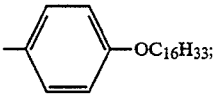

$R^2 =$ 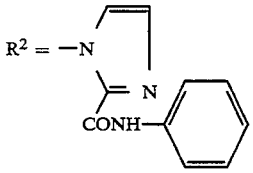

$R^3 = -OCH_3$; $R^4 = -SO_2N(CH_3)_2$; $R^5 = H$

Y-20: $R^1 =$ 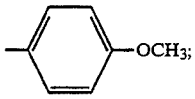

$R^2 =$ 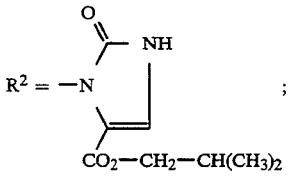 ;

$R^3 = -OCH_3$; $R^4 = H$;

$R_5 =$ 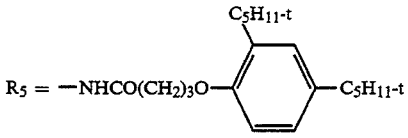

In a preferred embodiment, the recording material according to the invention, in at least one of its silver halide emulsion layers, contains a combination of a hydroquinone diether compound of formula I and a magenta coupler of formula VI

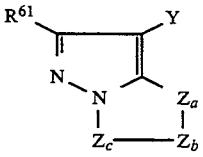

VI in which $R^{61}$ denotes H, alkyl, aralkyl or aryl;

Y denotes H or a group which can be liberated by coupling, and $Z_a$, $Z_b$, $Z_c$ denote an optionally substituted methine group, =N— or —NH—, either the $Z_a$—$Z_b$ bond or the $Z_b$—$Z_c$ bond being a double bond and the other bond being a single bond.

Formula VI couplers are collectively called pyrazoloazole couplers. These more particularly include couplers derived from imidazolo[1,2-b]pyrazole, imidazolo[3,4-b]pyrazole, pyrazolo[2,3-b]pyrazole, pyrazolo[3,2-c]-1,2,4-triazole, pyrazolo[2,3-b]-1,2,4]triazole, pyrazolo[2,3-c]-1,2,3-triazole or pyrazolo[2,3-d]tetrazole. The corresponding structures are shown hereinafter as formulae VIa to VIg.

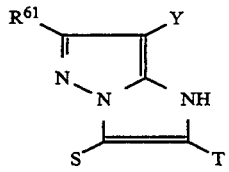
(VIa)

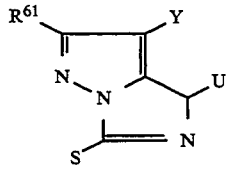
(VIb)

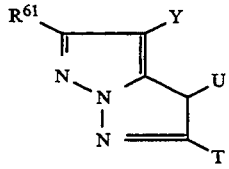
(VIc)

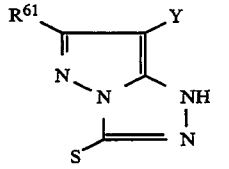
(VId)

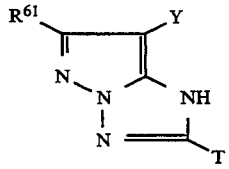
(VIe)

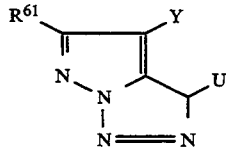
(VIf)

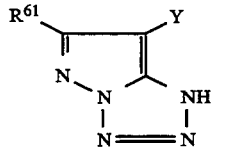
(VIg)

In the general formulae (VIa) to (VIg), the radicals $R^{61}$, S, T and U stand for hydrogen, alkyl, aralkyl, aryl, alkoxy, aroxy, alkylthio, arylthio, amino, anilino, acylamino, cyan, alkoxycarbonyl, carbamoyl or sulphamoyl, and these radicals can be additionally substituted.

Also Y stands for hydrogen or a radical which can be split off during colour coupling, e.g. a halogen atom or a preferably cyclic group linked to the coupling site via an oxygen atom, a sulphur atom or a nitrogen atom.

If the splittable group is a cyclic group, bonding to the coupling site of the coupling molecule can occur either directly via an atom forming part of a ring, e.g. a nitrogen atom, or indirectly via an interposed binding component. A large number of such splittable groups are known, e.g. in the form of alignment groups of 2-equivalent magenta couplers.

Examples of splittable groups bonded via oxygen correspond to the formula $$-O-R^{62}$$

where $R^{62}$ stands for an acyclic or cyclic organic radical, e.g. alkyl, aryl, or a heterocyclic group or acyl, derived e.g. from an organic carboxylic or sulphonic acid. In particularly preferred splittable groups of this kind, $R^{62}$ denotes an optionally substituted phenyl group.

Examples of splittable groups bonded via nitrogen are described in the following German Offenlegungsschriften (DE-A): 25 36 191, 27 03 589, 28 13 522, 33 39 201.

These are frequently 5-member heterocyclic rings bonded via a ring nitrogen atom to the coupling site of the purple coupler. The heterocyclic rings frequently contain activating groups, e.g. carbonyl or sulphonyl groups or double bonds, adjacent the nitrogen atom for bonding to the coupler molecule.

If the splittable group is bonded via a sulphur atom to the coupling site of the coupler, the group can be the radical of a diffusible carbocyclic or heterocyclic mercapto compound capable of inhibiting the development of silver halide. These inhibitor radicals, in the form of a splittable group bonded to the coupling site of couplers, including magenta couplers, have been frequently described, e.g. in U.S. Pat. No. 3,227,554.

Among the pyrazoloazole couplers of formulae VIa to VIg, use according to the invention is preferably made of formula VId and VIe substances together with a formula I hydroquinone diether compound. In formulae VId and VIe, preferably at least one of the radicals $R^{61}$ and S or at least one of the radicals $R^{61}$ and T stands for a secondary alkyl or tertiary alkyl radical, e.g. a radical having the formula:

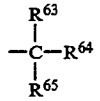

where $R^{63}$ and $R^{64}$ stand for alkyl and $R^{65}$ stands for H or a substituent.

The following are possible substituents: alkyl, aryl, cycloalkyl, hydroxy, halogen, —COOH, —$SO_3H$, —$SO_2H$, alkoxy, aryloxy, alkylthio, arylthio, nitro, sulphonyl, sulphamoyl, sulphonyl amino, acyl amino, carbamoyl, acyloxy, alkoxy carbonyl, aryloxy carbamoyl, ureido, carbamoyloxy, alkoxy carbonyl amino, aryloxy carbonyl amino, alkoxy carbonyloxy and aryloxy carbonyloxy.

The substituents are preferably alkyl, sulphonyl, sulphonylamino, sulphamoyl, ureido, acylamino, carbamoyl, alkoxy, aryloxy and alkoxy carbonyl amino.

The following are examples of formula VI pyrazoloazole couplers:

VI-1
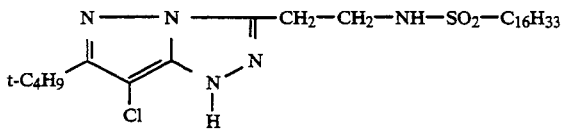
VI-2
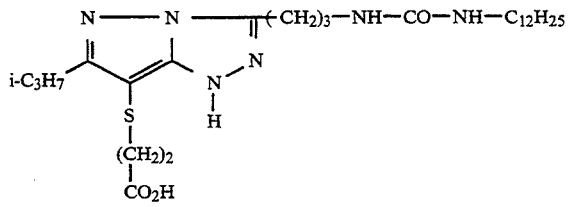
VI-3
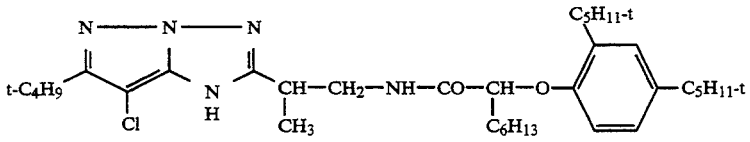
VI-4
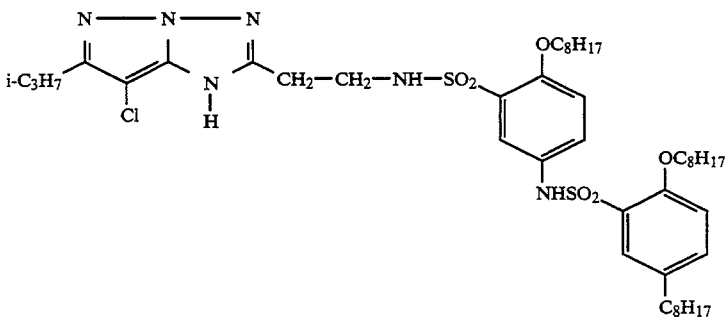
VI-5
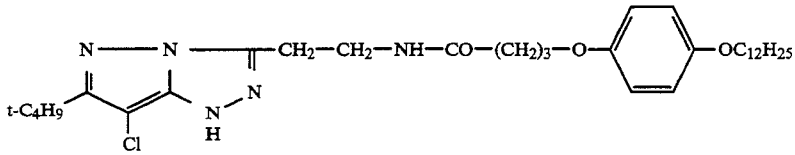
VI-6
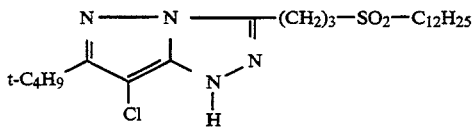
VI-7
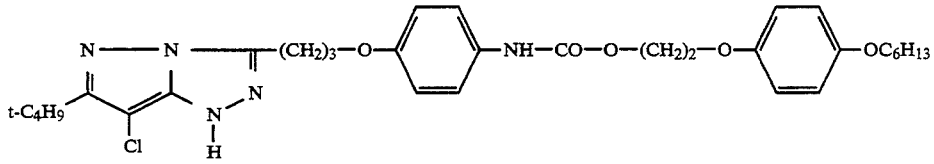
VI-8
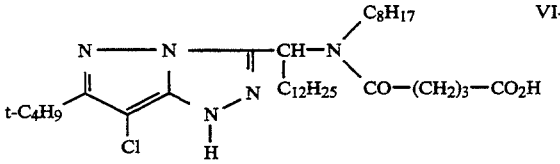
VI-9
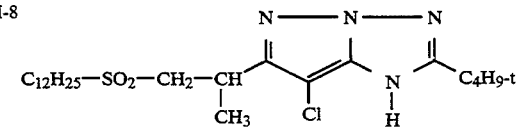
VI-10
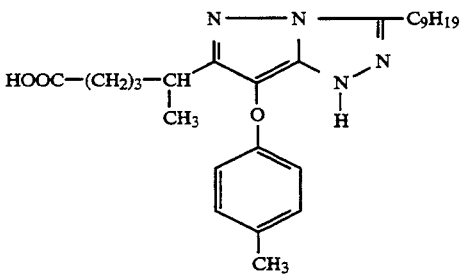
VI-11
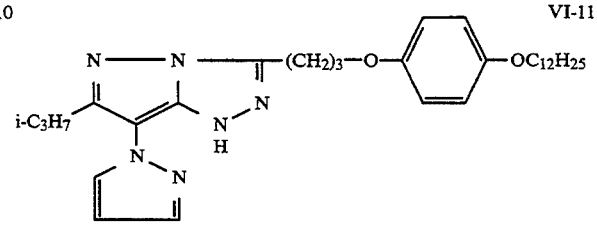

-continued
VI-12
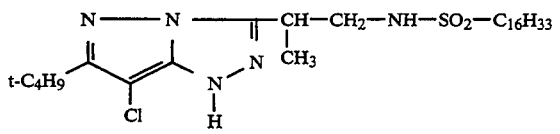
VI-13
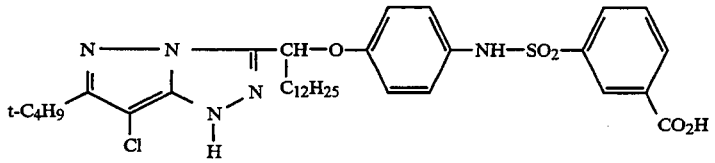
VI-14
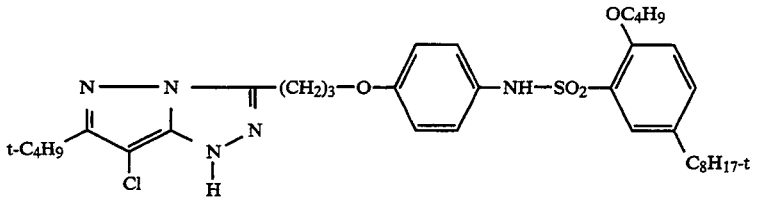
VI-15
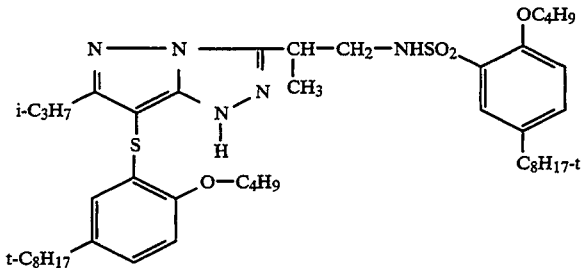
VI-16
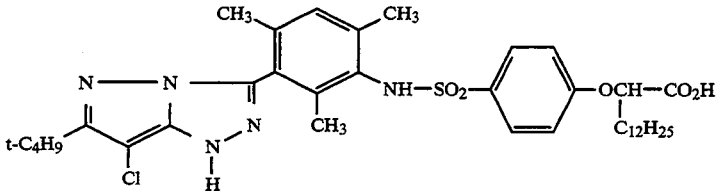
VI-17
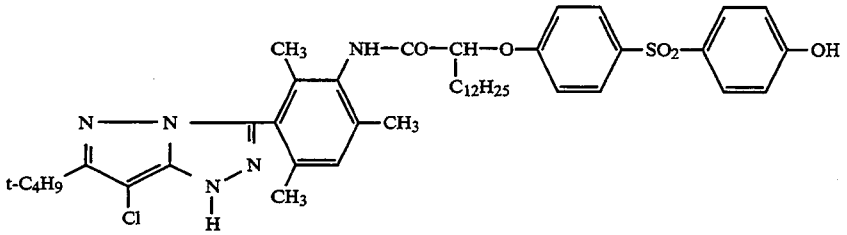
VI-18
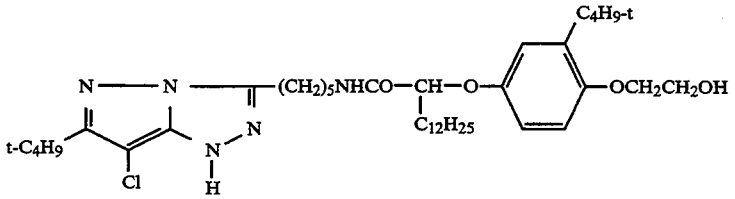
VI-19
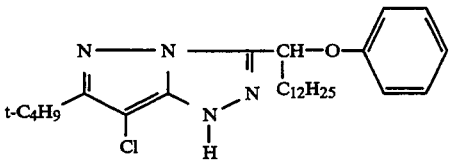
VI-20
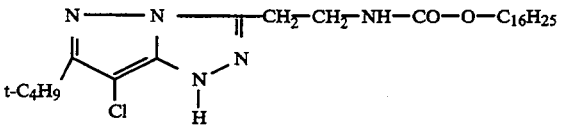

-continued
VI-21
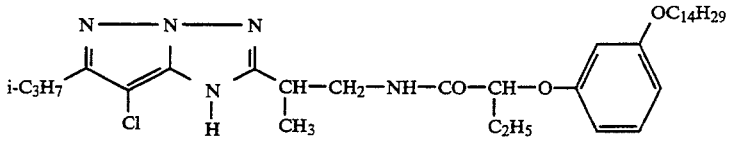
VI-22
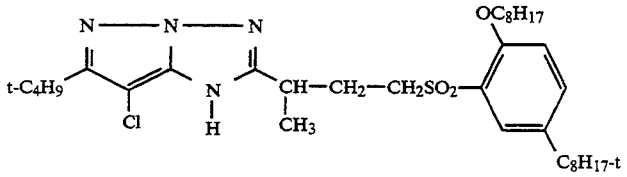
VI-23
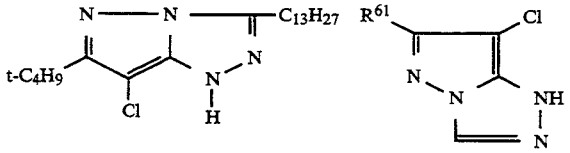
VI-24
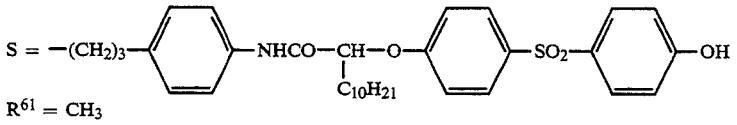
VI-25
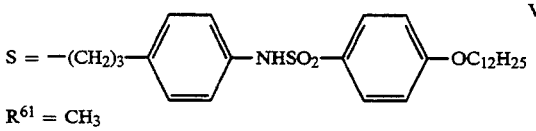
VI-26
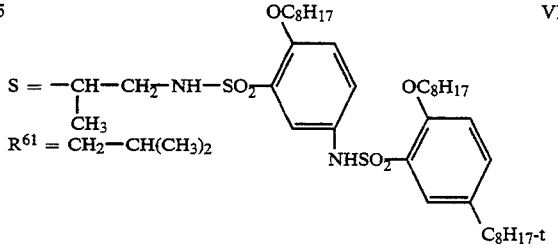
VI-27
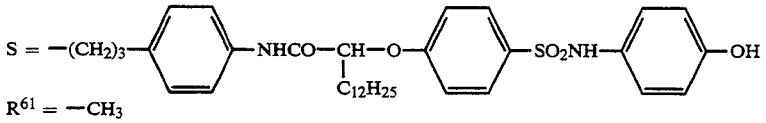
VI-28
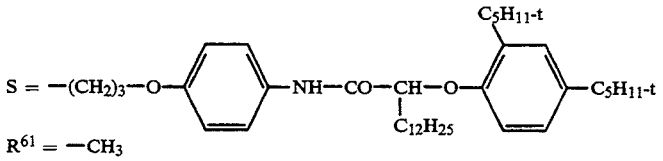
VI-29
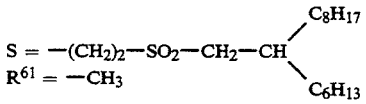
VI-30
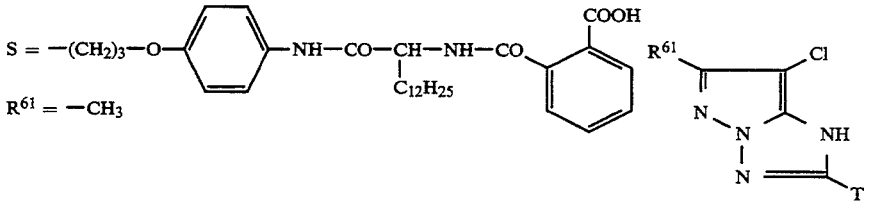

-continued

VI-31

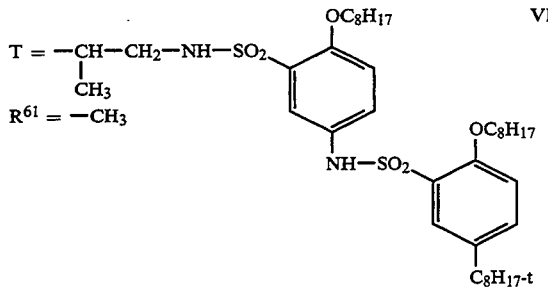

VI-32

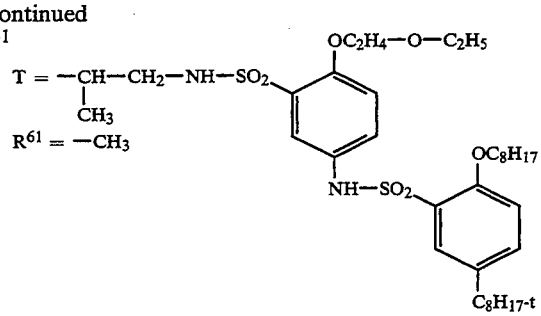

VI-33

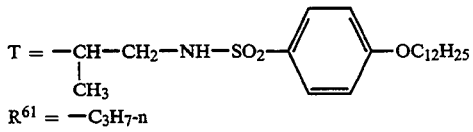

VI-34

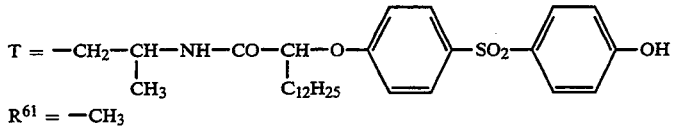

VI-35

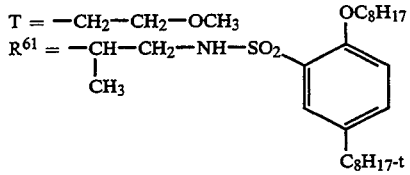

The color couplers can be 4-equivalent couplers or 2-equivalent couplers. The latter are derived from 4-equivalent couplers in that in the coupling site they contain a substituent which is split off during coupling. 2-equivalent couplers include substances which are colorless and substances which have an intense natural color which disappears during color coupling or is replaced by the color of the resulting image dye (mask couplers), and also white couplers, which yield substantially colorless products on reaction with color-developer oxidation products. 2-equivalent couplers also include couplers which, at the coupling site, contain a splittable radical which is liberated on reaction with colour developer oxidation products and either directly, or after one or more additional groups have been split off from the initially split-off radical (e.g. DE-A-27 03 145, DE-A-28 55 697, DE-A-31 05 026, DE-A-33 19 428), exerts a specific desired photographic activity, e.g. as a development inhibitor or accelerator. 2-equivalent couplers of this kind may e.g. be known DIR couplers or DAR or FAR couplers.

The couplers used, more particularly the pyrazoloazole-type magenta couplers preferably used according to the invention, e.g. of formulae (VId) or (VIe), can also be used in polymeric form, e.g. as polymer latices.

High-molecular dye couplers are described e.g. in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284 and U.S. Pat. No. 4,080,211. High-molecular dye couplers are usually produced by polymerisation of ethylenically unsaturated monomeric dye couplers.

The color couplers can also be substances which yield dyes with weak or limited mobility.

"Weak or limited mobility" means mobility such that the contours of the discrete color spots formed during chromogenic development run and smear into one another. Mobility of this order must be distinguished on the one hand from the normal case of complete immobility in photographic layers, which is aimed at in conventional photographic recording materials for color couplers or the resulting dyes, to obtain maximum sharpness, and on the other hand from the case of completely mobile colorants, which is the aim e.g. in color diffusion processes. The last-mentioned colorants usually have at least one group which makes them soluble in an alkaline medium. The amount of weak mobility aimed at according to the invention can be controlled by varying the substituents, in order e.g. to influence the solubility of the oil-forming agent in an organic medium or the affinity of the binder matrix in controlled manner.

In addition to the aforementioned components, the color photographic recording material according to the invention can contain other additives, such as anti-oxidising agents, color-stabilising substances, substances for influencing the mechanical and electrostatic properties, and UV absorbers. Preferably these additional substances are used in combination with the compounds according to the invention, i.e. in the same binder layer or in adjacent binder layers.

These additional substances for improving the dye, coupler and white stability and for reducing the color haze (Research Disclosure 17 643 (December 1978), Chapter VII) can belong to the following classes of chemical substances: hydroquinones, 5-, 6-, 7- and 8-hydroxychromans, 5-hydroxycumarans, spirochromans, spiroindans, p-alkoxyphenols, sterically hindered phenols, gallic acid derivatives, methylene dioxybenzenes, amino phenols, sterically hindered amines, derivatives with esterified or etherified phenolic hydroxyl groups, derivatives with acylated amino groups, or metal complexes.

Compounds which contain both a sterically hindered amine partial structure and a sterically hindered phenol partial structure in the same molecule (U.S. Pat. No. 4,268,593) are particularly effective at preventing yellow color images from being damaged by heat, moisture or light. Spiroindans (JP-A-159 644/81) and chromans substituted by alkoxy and/or hydroxy groups (JP-A-89 835/80) are particularly effective at preventing damage to magenta color images, particularly by light, and the same applies to alkyl ureidophenols (German patent application P 42 09 346.5).

The following are examples of particularly suitable compounds:

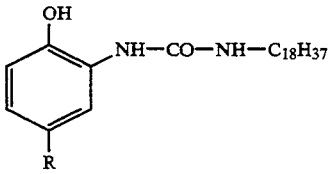

(with R = $-C_2H_5$, $-C_4H_9$-s, $-C_4H_9$-t)

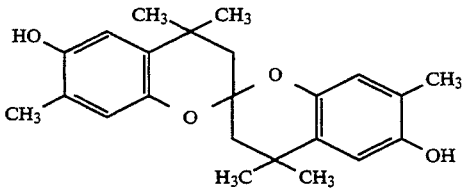

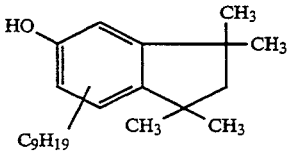

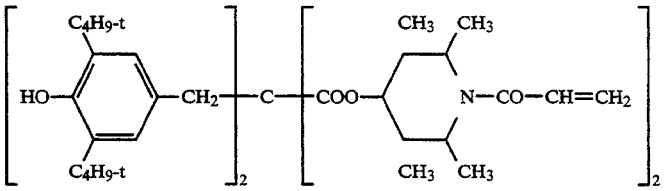

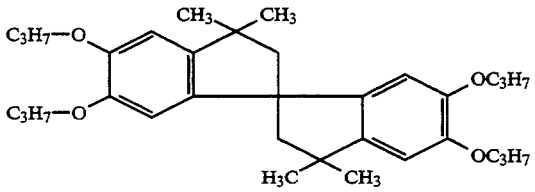

UV light-absorbing compounds are designed on the one hand to protect the image dyes from being bleached by high-UV daylight and on the other hand to filter and absorb the UV light in daylight during illumination and thus improve the reproduction of colour in a film. Normally the compounds used for the two purposes have different structures. The following are examples: aryl substituted benzotriazole compounds (U.S. Pat. No. 3,533,794), 4-thiazolidone compounds (U.S. Pat. Nos. 3,314,794 and 3,352,681), benzophenone compounds (JP-A-2784/71), cinnamic acid ester compounds (U.S. Pat. Nos. 3,705,805 and 3,707,375), butadiene compounds (U.S. Pat. No. 4,045,229) or benzoxazole compounds (U.S. Pat. No. 3,700,455).

The following are examples of particularly suitable compounds:

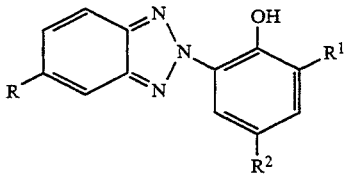

R, $R^1$ = H; $R^2$ = $-C_4H_9$-t

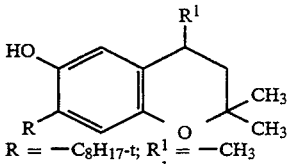

R = $-C_8H_{17}$-t; $R^1$ = $-CH_3$
R = $-C_8H_{17}$; $R^1$ = $-C_3H_7$-i

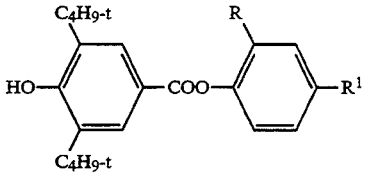

R, $R^1$ = $-C_4H_9$-t
R, $R^1$ = $-C_5H_{11}$-t

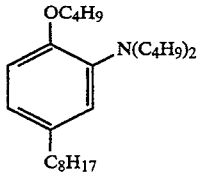

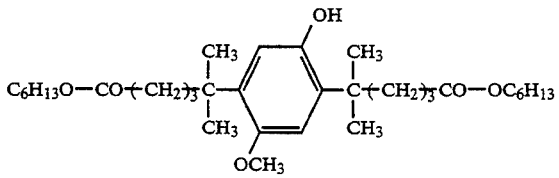

R = H; $R^1$, $R^2$ = $-C_4H_9$-t
R = H; $R^1$, $R^2$ = $-C_5H_{11}$-t
R = H; $R^1$ = $-C_4H_9$-s; $R^2$ = $-C_4H_9$-t
R = Cl; $R^1$ = $-C_4H_9$-t; $R^2$ = $-C_4H_9$-s
R = Cl; $R^1$, $R^2$ = $-C_4H_9$-t
R = Cl; $R^1$ = $-C_4H_9$-t; $R^2$ = $-CH_2-CH_2-COOC_8H_{17}$
R = H; R = $-C_{12}H_{25}$-i; $R^2$ = $-CH_3$
R, $R^1$, $R^2$ = $-C_4H_9$-t

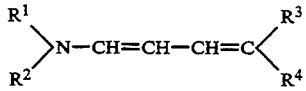

-continued $R^1, R^2 = -C_6H_{13}$; $R^3, R^4 = -CN$
$R^1, R^2 = -C_2H_5$;

$R^3 = -SO_2-$ 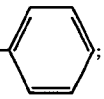 ;

$R^4 = -CO-OC_8H_{17}$
$R^1, R^2 = -C_2H_5$;

$R^3 = -SO_2-$ 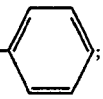 ;

$R_4 = -COO-C_{12}H_{25}$
$R^1, R^2 = -CH_2=CH-CH_2$; $R^3, R^4 = -CN$

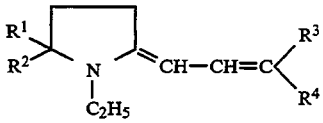

$R^1, R^2 = H$; $R^3 = -CN$; $R^4 = -CO-NHC_{12}H_{25}$
$R^1, R^2 = -CH_3$; $R^3 = -CN$; $R^4 = -CO-NHC_{12}H_{25}$

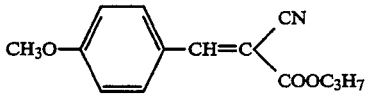

Use can also be made of ultraviolet-absorbing couplers (e.g. α-naphthole-type cyan couplers) and ultraviolet-absorbing polymers. These ultraviolet-absorbing agents can be fixed in a special layer by mordanting.

In order to produce color photographic pictures, the color photographic recording material according to the invention, which contains a color coupler and a formula I compound associated with at least one silver halide emulsion layer, is developed by means of a color developer compound. The color developer compound can be any developer compound capable, in the form of its oxidation product, of reacting with dye couplers to form azomethine colorants. The following color-developing compounds are suitable: aromatic compounds containing at least one primary amino group and of the same type as p-phenylene diamine, e.g. N,N-dialkyl-p-phenylene diamines such as N,N-diethyl-p-phenylene diamine, 1-(N-ethyl-N-methyl sulphonamidoethyl)-3-methyl-p-phenylene diamine, 1-(N-ethyl-N-hydroxyethyl-3-methyl-p-phenylene diamine, 1-(N-ethyl-N-3-hydroxypropyl)-3-methyl-p-phenylene diamine and 1-(N-ethyl-N-methoxymethyl)-3-methyl-p-phenylene diamine.

Other suitable color developers are described e.g. in J. Amer. Chem. Soc. 73, 3100 (1951); in G. Haist, Modern Photographic Processing, 1979, John Wiley and Sons, New York, pages 545 ff and in German patent application P 42 41 532.2.

After the color development, the material is usually bleached and fixed. Bleaching and fixing can be carried out separately or together. The bleaching agents can be the normal compounds, e.g. $Fe^{3+}$ salts or $Fe^{3+}$ complex salts such as ferricyanides, dichromates, water-soluble cobalt complexes etc. Iron-III-complexes of aminopolycarboxylic acids, particularly ethylene diamine tetraacetic acid, N-hydroxyethyl ethylene diamine triacetic acid, alkyl iminodicarboxylic acids and corresponding phosphonic acids are particularly preferred. Persulphates are also suitable as bleaching agents.

EXAMPLE 1

A color photographic recording material suitable for rapid processing was prepared by applying the following layers in the given sequence to a paper substrate coated on both sides with polyethylene. The quantities in each case are per 1 $m^2$. In the case of the silver halide layer, the corresponding amounts of $AgNO_3$ are given:

Layer structure Sample 1
Layer 1:
(Substrate layer)
0.2 g gelatine
Layer 2:
(blue-sensitive layer)
blue-sensitive silver halide emulsion
(99.5 mol. % chloride, 0.5 mol. % bromide, average
grain diameter 0.8 μm) of 0.63 g
$AgNO_3$ with
1.38 g gelatine
0.95 g yellow coupler Y-9
0.2 g white coupler W-1
0.29 g tricresyl phosphate (TKP)
Layer 3: (Protective layer)
1.1 g gelatine
0.06 g 2,5-dioctyl hydroquinone
0.06 g dibutyl phthalate (DBP)
Layer 4: (green-sensitive layer)
green-sensitised silver halide emulsion (99.5
mol. % chloride, 0.5 mol. % bromide, average grain
diameter 0.6 μm) of 0.45 g $AgNO_3$ with
1.08 g gelatine
0.41 g magenta coupler VI-1
0.08 g 2,5-dioctyl hydroquinone
0.34 g DBP
0.04 g TKP
Layer 5: (Anti-UV layer)
1.15 g gelatine
0.6 g UV absorber UV-1
0.045 g 2,5-dioctyl hydroquinone
0.04 g TKP
Layer 6: (red-sensitive layer)
red-sensitised silver halide emulsion
(99.5 mol. % chloride, 0.5 mol. % bromide, average
grain diameter 0.5 μm) of 0.3 g $AgNO_3$ with
0.75 g gelatine
0.36 g cyan coupler C-24
0.36 g TKP
Layer 7: (Anti-UV layer)
0.35 g gelatine
0.15 g UV absorber UV-1
0.2 g TKP
Layer 8: (Protective layer)
0.9 g gelatine
0.3 g hardening agent Carbamoyl pyridinium salt CAS Reg. No. 65411- 60-1

The following compound (white coupler W-1) was used in layer 2:

W-1

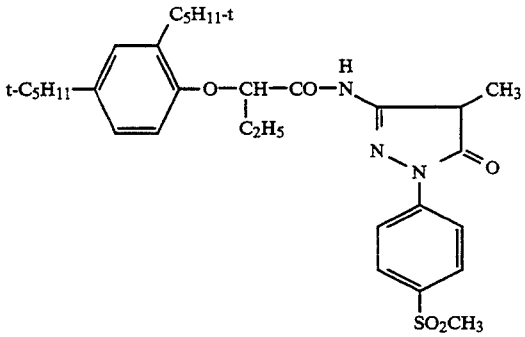

In layers 5 and 7, the following compound (UV-absorber UV-1) was used:

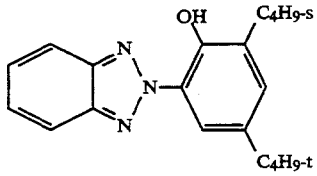

Samples 2 to 20

Samples 2 to 9 were manufactured in the same manner as Sample 1, except that 0.31 g of light-excluding agents having the structural formulae VP-1 to VP-3 or light-excluding agents according to the invention and having the structural formula I were also added to layer 4. In samples 10 to 13, 14 to 17 and 18 to 20, the coupler VI-1 was replaced by other formula VI couplers in proportions shown in the following Table. In the case of coupler VI-23, also, 0.34 g DBP and 0.04 g TKP in the fourth layer were replaced by 0.38 g of 2,4-di-tert-pentyl phenol (samples 18 to 20).

According to the invention, 0.31 g of formula I light-excluding agent was added to samples 11–12, 15–16 and 19, comprising formula VI couplers. For comparison, samples 2–4, 13, 17 and 20 contained a compound having one of the formulae VP-1, VP-2, VP-3.

VP-1

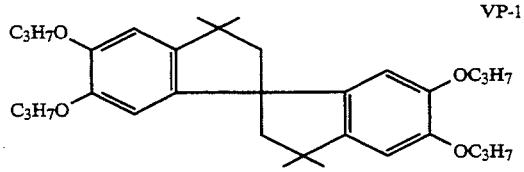

-continued

VP-2

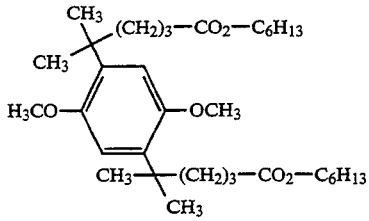

VP-3

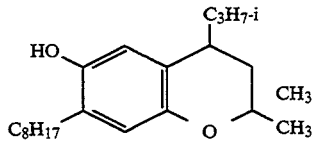

The samples were then exposed behind a graduated neutral wedge filter. The materials were then processed in the following manner in the baths listed hereinafter.

a) Color developer—45 s—35° C.

| | |
|---|---|
| Triethanolamine | 9.0 g |
| NN-diethyl hydroxylamine | 4.0 g |
| Diethylene glycol | 0.05 g |
| 3-methyl-4-amino-N-ethyl-N-methane sulphonamidoethyl aniline sulphate | 5.0 g |
| Potassium sulphite | 0.2 g |
| Triethylene glycol | 0.05 g |
| Potassium carbonate | 22 g |
| Potassium hydroxide | 0.4 g |
| Ethylene diamine tetraacetic acid di-Na salt | 2.2 g |
| Potassium chloride | 2.5 g |
| 1,2-dihydroxybenzene-3,4,6-trisulphonic acid trisodium salt | 0.3 g |
| Made up with water to 1000 ml; pH 10.0 | |

b) Bleaching and fixing bath—45 s—35° C.

| | |
|---|---|
| Ammonium thiosulphate | 75 g |
| Sodium hydrogen sulphite | 13.5 g |
| Ammonium acetate | 2.0 g |
| Ethylene diamine tetraacetic acid (iron ammonium salt) | 57 g |
| 25% ammonia | 9.5 g |
| Made up with acetic acid to 1000 ml; pH 5.5 | |

c) Washing—2 minutes—33° C.

The samples were exposed to the light of a xenon lamp standardised for daylight and illuminated with $5.0\times10^6$ lx.h, after which the percentage decrease in density was measured (Table 1).

TABLE 1

| Sample | | Coupler Compound | Light-stabilising agent | Illumination, $5\times10^6$ lux.h % decrease in density at D = 1.0 | D = 2.0 |
|---|---|---|---|---|---|
| 1 (Comparison) | 0.38 g | VI-1 | — | 79 | 23 |
| 2 (Comparison) | 0.38 g | VI-1 | 0.31 g compound VP-1 | 43 | 17 |
| 3 (Comparison) | 0.38 g | VI-1 | 0.31 g compound VP-2 | 55 | 21 |
| 4 (Comparison) | 0.38 g | VI-1 | 0.31 g compound VP-3 | 45 | 18 |
| 5 (acc to the invention) | 0.38 g | VI-1 | 0.31 g compound I-1 | 25 | 10 |
| 6 (acc to the invention) | 0.38 g | VI-1 | 0.31 g compound I-4 | 18 | 7 |
| 7 (acc to the invention) | 0.38 g | VI-1 | 0.31 g compound I-5 | 13 | 5 |
| 8 (acc to the invention) | 0.38 g | VI-1 | 0.31 g compound I-7 | 22 | 8 |
| 9 (acc to the invention) | 0.38 g | VI-1 | 0.31 g compound I-14 | 24 | 7 |
| 10 (Comparison) | 0.42 g | VI-5 | — | 26 | 6 |
| 11 (acc to the invention) | 0.42 g | VI-5 | 0.31 g compound I-4 | 11 | 6 |
| 12 (acc to the invention) | 0.42 g | VI-5 | 0.31 g compound I-5 | 8 | 3 |
| 13 (Comparison) | 0.42 g | VI-5 | 0.31 g comp. cpd. VP-1 | 23 | 6 |
| 14 (Comparison) | 0.34 g | VI-6 | — | 67 | 7 |

TABLE 1-continued

| Sample | | Coupler Compound | Light-stabilising agent | Illumination, 5 × $10^6$ lux.h % decrease in density at D = 1.0 | D = 2.0 |
|---|---|---|---|---|---|
| 15 (acc to the invention) | 0.34 g | VI-6 | 0.31 g compound I-4 | 17 | 2 |
| 16 (acc to the invention) | 0.34 g | VI-6 | 0.31 g compound I-5 | 14 | 2 |
| 17 (Comparison) | 0.34 g | VI-6 | 0.31 g comp. cpd. VP-1 | 30 | 9 |
| 18 (Comparison) | 0.35 g | VI-23 | — | 75 | 38 |
| 19 (acc to the invention) | 0.35 g | VI-23 | 0.31 g compound I-5 | 18 | 6 |
| 20 (Comparison) | 0.35 g | VI-23 | 0.31 g comp. cpd. VP-1 | 47 | 20 |

As the example shows, the light stability of the image colorants is considerably improved by the formula I compounds according to the invention. The compounds VP-1 to VP-3 according to GB-A 2 135 788 used for comparison produce a considerably smaller improvement in light stability.

EXAMPLE 2

The substance used for comparison was sample 14 as described in Example 1.

Samples 21 to 23 according to the invention differ from sample 14 in that in the green-sensitive layer DBP and TKP were replaced by 0.4 g of formula I light-excluding agent. Processing and testing were as described in Example 1 (Table 2).

TABLE 2

| Sample | Coupler | Oil-forming agent | Rel. sensitivity magenta | Gradation | $D_{max}$ | Irradiation, 5 × $10^6$.lux.h % decrease in density at D = 0.5 | D = 1.0 |
|---|---|---|---|---|---|---|---|
| 14 | 0.31 g of cpd. VI-6 | 0.34 g DBP + 0.04 TKP | 100 | 2.75 | 2.61 | 81 | 67 |
| 21 | 0.31 g of cpd. VI-6 | 0.38 g cpd. I-4 | 99 | 2.72 | 2.63 | 21 | 16 |
| 22 | 0.31 g of cpd. VI-6 | 0.38 g cpd. I-9 | 101 | 2.73 | 2.58 | 25 | 21 |
| 23 | 0.31 g of cpd. VI-6 | 0.38 g cpd. I-17 | 102 | 2.76 | 2.62 | 14 | 9 |

Example 2 shows that the formula 1 light-excluding agents according to the invention can be used as oil-forming agents in combination with pyrazoloazole couplers. The sensitivity, gradation and maximum density are comparable with DBP/TKP, whereas the light stability is appreciably increased.

EXAMPLE 3

In this example, the advantages of the steps according to the invention are shown in the case of a color reversal film.

Color photographic recording materials for reversal processing were manufactured by applying the following layers in succession to a cellulose triacetate substrate coated with an adhesive layer.

The quantities in each case are per $m^2$.

Sample 24 (comparison)

Layer 1
(anti-halo layer)
Black colloidal silver sol with
0.25 g Ag
1.60 g gelatine and
0.24 g UV absorber UV-2

Layer 2
(Intermediate layer)
0.64 g gelatine

Layer 3
(First red-sensitive layer)
Red-sensitive silver bromide-iodide emulsion
(25 mol. % iodide;
average grain diameter 0.25 μm)
of 0.60 g $AgNO_3$, with
0.59 g gelatine
0.24 g cyan coupler C-25
0.12 g TKP Layer 4
(Second red-sensitised layer)
Red-sensitised silver bromide-iodide emulsion
(3.0 mol. % iodide;
Average grain diameter 0.43 μm)
of 0.95 g $AgNO_3$, with
1.96 g gelatine
0.95 g cyan coupler C-25
0.48 g TKP Layer 5
(Intermediate layer)
1.78 g gelatine
0.24 g compound A
0.12 g TKP Layer 6
(1st green-sensitised layer)
3:1 mixture of a silver bromide-iodide emulsion
(1.0 mol. % iodide;
Average grain diameter 0.26 μm)
and a silver bromide-iodide emulsion
4.0 mol. % iodide; average grain diameter
0.21 μm), both green-sensitised,
of 0.67 g $AgNO_3$, with
1.13 g gelatine
0.22 g magenta coupler VI-7
0.10 g TKP Layer 7
(2nd green-sensitised layer)
Green-sensitised silver bromide-iodide emulsion
(1.5 mol. % iodide;
Average grain diameter 0.42 μm)
of 1.05 g $AgNO_3$, with
2.72 g gelatine
1.00 g magenta coupler VI-7
0.45 g TKP Layer 8
(Intermediate layer)
0.55 g gelatine
0.10 g compound A Layer 9
(Yellow filter layer)
Yellow colloidal silver sol with
0.11 g Ag,
0.45 gelatine Layer 10
(Intermediate layer)
0.71 g gelatine
Layer 11
(1st blue-sensitive layer)
Blue-sensitised silver bromide-iodide emulsion
(4.0 mol. % iodide;
Average grain diameter 0.28 μm)
of 0.58 g $AgNO_3$, with
1.31 g gelatine
0.24 g yellow coupler Y-19
0.12 g TKP
Layer 12
(2nd blue-sensitive layer)
Blue-sensitised silver bromide-iodide emulsion
(3.0 mol. % iodide;
Average grain diameter 0.66 μm)
of 0.66 g $AgNO_3$, with
2.04 g gelatine
0.83 g yellow coupler Y-19
0.41 g TKP
Layer 13
(Intermediate layer)
0.76 g gelatine
0.54 g compound A
0.50 g UV absorber UV-1
0.02 g TKP
Layer 14
(Protective layer)
Micrate silver bromide-iodide emulsion
(4.0 mol. % iodide;
Average grain diameter 0.15 μm)
of 0.20 g $AgNO_3$ with
0.57 g gelatine
Layer 15
Hardening layer
0.25 g gelatine
0.87 g hardening agent Carbamoyl pyridinium salt
CAS Reg. No. 65411-60-1

In Example 3, in addition to the already-mentioned compounds, the following compounds were used:

UV-2

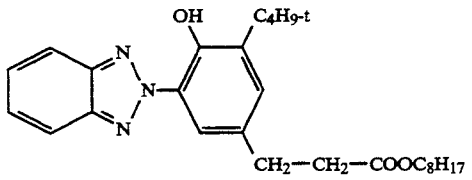

-continued

Compound A

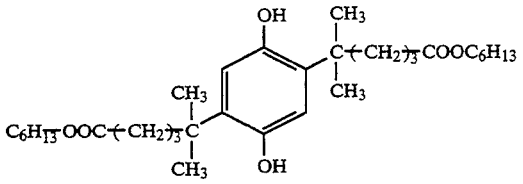

Samples 25 to 30

The samples 25 and 26 according to the invention were manufactured in the same manner as sample 24 except that the oil-forming agent TKP in layers 6 and 7 was replaced by compounds I-14 and I-17. In sample 27, the coupler VI-7 was replaced by the coupler VI-14, and TKP was used as an oil-forming agent (for comparison).

The samples 28 to 30 according to the invention differ from sample 27 in that TKP in layers 6 and 7 was replaced by the compounds I-4, I-14 and I-17.

The resulting samples were exposed behind a stepped photometric absorption wedge and subjected to color reversal development as described in "Manual for PROCESSING Kodak Ektrachrome Film using Process E7", Eastman Kodak Company, 1977 (compare Kodak Publication No. Z-119).

The light stability test was made as described in Example 1, but using $7.5\times10^6$ lux.h illumination. The results are shown in Table 3.

TABLE 3

| Sample | Coupler | Oil-forming agent | Rel. sensitivity, magenta | Gradation | $D_{max}$ | % Decrease in density at D = 1.0 | % Decrease in density at D = 2.0 |
|---|---|---|---|---|---|---|---|
| 24 | 1.12 cpd. VI-7 | 0.55 g TKP | 100 | 1.73 | 3.14 | 43 | 25 |
| 25 | 1.12 cpd. VI-7 | 0.55 g cpd. I-14 | 102 | 1.71 | 3.08 | 13 | 11 |
| 26 | 1.12 cpd. VI-7 | 0.55 g cpd. I-17 | 99 | 1.73 | 3.12 | 11 | 9 |
| 27 | 1.22 cpd. VI-14 | 0.55 g TKP | 101 | 1.78 | 3.11 | 58 | 29 |
| 28 | 1.22 cpd. VI-14 | 0.55 g cpd. I-4 | 100 | 1.76 | 3.12 | 24 | 18 |
| 29 | 1.22 cpd. VI-14 | 0.55 g cpd. I-14 | 102 | 1.77 | 3.08 | 19 | 20 |
| 30 | 1.22 cpd. VI-14 | 0.55 g cpd. I-17 | 103 | 1.79 | 3.13 | 15 | 11 |

The example shows that the formula 1 compounds according to the invention can appreciably increase the light sensitivity of the image dyes in color reversal films. The sensitivity, gradation and maximum density were not adversely influenced.

EXAMPLE 4

A color photographic recording material suitable for a high-speed process was prepared as in Example 1, sample 1, except that in layer 4 the magenta coupler VI-1 was replaced by the magenta coupler VI-6 in a quantity of 0.41 g, and exclusively 0.38 g TKP was used instead of the oil-forming mixture (sample 31).

Samples 32–52 were prepared in the same manner as sample 31, except that the light-excluding agents VP-1, VP-3, given in Table 1 or light-excluding agents according to the invention were also added to layer 4.

The processing, irradiation and evaluation of the samples were as in Example 1, except that the illumination was at $10\times10^6$ lux.h. The results are shown in Table 4.

TABLE 4

| Sample | Light-excluding agent 1 | Quantity | Light-excluding agent 2 | Quantity | Irradiation: 10 × $10^6$ lux.h % Density decrease at D = 1.0 | D = 2.0 |
|---|---|---|---|---|---|---|
| 31 (V) | — | — | — | — | 82 | 36 |
| 32 (V) | VP-1 | 0.40 g | — | — | 44 | 27 |
| 33 (E) | I-4 | 0.40 g | — | — | 44 | 25 |
| 34 (E) | I-5 | 0.40 g | — | — | 40 | 22 |
| 35 (E) | I-26 | 0.40 g | — | — | 41 | 23 |
| 36 (V) | VP-1 | 0.20 g | II-11 | 0.20 g | 52 | 34 |
| 37 (V) | VP-1 | 0.20 g | II-3 | 0.20 g | 45 | 26 |
| 38 (E) | I-4 | 0.20 g | VP-3 | 0.20 g | 48 | 29 |
| 39 (E) | I-5 | 0.20 g | II-3 | 0.20 g | 24 | 13 |
| 40 (E) | I-5 | 0.20 g | III-4 | 0.20 g | 23 | 13 |
| 41 (E) | I-5 | 0.20 g | IV-3 | 0.20 g | 28 | 15 |
| 42 (E) | I-5 | 0.20 g | V-5 | 0.20 g | 26 | 14 |
| 43 (E) | I-26 | 0.20 g | II-7 | 0.20 g | 26 | 13 |
| 44 (E) | I-26 | 0.20 g | III-1 | 0.20 g | 25 | 14 |
| 45 (E) | I-26 | 0.20 g | IV-5 | 0.20 g | 27 | 15 |
| 46 (E) | I-26 | 0.20 g | V-3 | 0.20 g | 30 | 16 |
| 47 (E) | I-4 | 0.15 g | III-8 | 0.25 g | 28 | 15 |
| 48 (E) | I-7 | 0.25 g | IV-2 | 0.15 g | 29 | 15 |
| 49 (E) | I-8 | 0.10 g | V-7 | 0.20 g | 26 | 13 |
| 50 (E) | I-12 | 0.10 g | III-17 | 0.20 g | 24 | 12 |
| 51 (E) | I-23 | 0.20 g | IV-7 | 0.20 g | 32 | 18 |
| 52 (E) | I-27 | 0.25 g | V-1 | 0.15 g | 25 | 14 |

V = Comparison
E = According to the invention

Example 4 shows that the light stability can be improved (samples 33, 34, 35, 38) by using formula I light-protecting agents, and the light stability obtained by means of formula I compounds can be further improved if the formula I compounds are used in combination with formula II, III, IV or V compounds (samples 39–52).

EXAMPLE 5

Sample 31 from Example 4 was used for comparison.

Samples 53–59

Samples 53–59 were prepared in the same manner as sample 31 in Example 4, except that the oil-forming agent in layer 4 was replaced by formula I compounds according to the invention and other compounds of formula II, III, IV and V or the comparison compound VP-3 were added.

Processing and testing were as described in Example 1. In addition, the sensitivity, gradation and maximum density of the processed samples were determined before illumination. The results are given in Table 5.

TABLE 5

| Sample | Oil-forming forming agent | Light-excluding agent | Quantity | Rel. sensitivity magenta | Gradation magenta | $D_{max}$ magenta | Irradiation: 10 × $10^6$ lux.h % decrease in density at D = 0.5 | D = 1.5 |
|---|---|---|---|---|---|---|---|---|
| 31 | TKP | — | — | 100 | 2.75 | 2.61 | 89 | 63 |
| 53 (E) | I-5 | — | — | 99 | 2.72 | 2.62 | 57 | 38 |
| 54 (E) | I-5 | VP-3 | 0.30 g | 98 | 2.70 | 2.58 | 45 | 30 |
| 55 (E) | I-5 | II-5 | 0.30 g | 100 | 2.76 | 2.61 | 26 | 18 |
| 56 (E) | I-5 | III-7 | 0.30 g | 102 | 2.80 | 2.65 | 24 | 18 |
| 57 (E) | I-9 | IV-6 | 0.30 g | 101 | 2.75 | 2.64 | 27 | 20 |
| 58 (E) | I-17 | III-4 | 0.30 g | 100 | 2.74 | 2.62 | 28 | 19 |
| 59 (E) | I-21 | V-5 | 0.30 g | 101 | 2.77 | 2.63 | 30 | 20 |

Example 5 shows that the formula 1 light-protecting agents according to the invention can additionally serve as oil-forming agents without disadvantageous effects on sensitivity, gradation and maximum density. A further appreciable increase in light stability is obtained by the combination according to the invention with formula II, III, IV or V compounds. The comparison compound VP-3 is considerably less effective.

EXAMPLE 6

Sample 60

A paper substrate coated with polyethylene on both sides was covered with the following layers. The quantities are per $m^2$.

Layer 1: A substrate layer of 200 mg gelatine with added
$KNO_3$- and chrome alum.

Layer 2: An adhesive layer of 320 mg gelatine.

Layer 3: A green-sensitive silver bromide-chloride emulsion layer (20 mol. % chloride) of
530 mg $AgNO_3$ with 750 mg gelatine,
0.57 g magenta coupler VI-1, emulsified with
0.51 g TKP.

Layer 4: A protective layer of 1 g gelatine and 16 mg of a wetting agent having the formula $$C_8F_{17}SO_3^{\ominus}N(C_2H_5)_4)_4^{\ominus} \quad \text{(NM-1)}$$

This layer was covered by a hardening layer, in which the hardening agent was 120 mg carbamoyl pyridinium salt CAS Reg. No. 65411-60-1.

Samples 61–77

Samples 61–77 were prepared in the same manner as sample 60, except that the light-excluding agents in Table 6 were added to layer 3. In samples 65–77 also, the magenta coupler VI-1 was replaced by the substances in Table 6 (VI-5, VI-23).

The resulting samples were then exposed behind a graduated neutral wedge filter. The materials were then processed as follows in the baths listed hereinafter:

| | |
|---|---|
| Development: | 210 s, 33° C. |
| Bleaching: | 50 s, 20° C. |
| Fixing: | 60 s, 20° C. |
| Washing: | 120 s, 20° C. |
| Drying | |

| Composition of the baths | |
|---|---|
| Developer: | |
| Benzyl alcohol | 13 ml |
| Hydroxyl ammonium sulphate | 3 g |
| Sodium sulphite | 2 g |
| 4-amino-N-ethyl-N(β-methane-sulphonamido-ethyl)-m-toloidine sesquisulphate (monohydrate) | 4.5 g |
| Potassium carbonate | 36 g |
| Potassium bromide | 1.4 g |
| Diethylene-triamino-pentaacetic acid, pentasodium salt | 2 g |
| Diethylene glycol | 12 ml |
| Made up with water to 1 liter pH = | 10.4 |
| Bleaching bath: | |
| Water | 700 ml |
| $NH_4$—Fe-EDTA | 65 g |
| EDTA | 10 g |
| $MMH_4Br$ | 100 g |
| Adjusted to pH 6.0 with acetic acid | |
| Made up to 1 liter with water. | |
| Fixing bath: | |
| Ammonium thiosulphate | 100 g |
| Sodium sulphite, anhydrous | 10 g |
| Sodium disulphite | 3 g |
| Made up to 1 liter with water. | |

In addition, the samples were exposed to the light of a xenon lamp standardised for daylight and illuminated at $7.2\times10^6$ lx.h, after which the percentage decrease in density was measured (Table 6).

TABLE 6

| Sample | Coupler | Quantity | Light-protecting agent 1 | Quantity | Light-protecting agent 2 | Quantity | % decrease in density at D = 1.0 | D = 1.5 |
|---|---|---|---|---|---|---|---|---|
| 60 (V) | VI-1 | 0,51 g | — | — | — | — | 79 | 54 |
| 61 (V) | VI-1 | 0,51 g | VP-1 | 0,5 g | — | — | 40 | 30 |
| 62 (E) | VI-1 | 0,51 g | I-5 | 0,5 g | — | — | 38 | 29 |
| 63 (E) | VI-1 | 0,51 g | I-5 | 0,25 g | III-8 | 0,25 g | 25 | 18 |
| 64 (E) | VI-1 | 0,51 g | I-5 | 0,25 g | III-3 | 0,25 g | 26 | 20 |
| 65 (V) | VI-5 | 0,55 g | — | — | — | — | 68 | 47 |
| 66 (E) | VI-5 | 0,55 g | I-22 | 0,28 g | II-11 | 0,28 g | 42 | 31 |
| 67 (E) | VI-5 | 0,55 g | I-22 | 0,14 g | III-1 | 0,28 g | 22 | 14 |
| 68 (E) | VI-5 | 0,55 g | I-22 | 0,14 g | IV-5 | 0,28 g | 26 | 16 |
| 69 (V) | VI-23 | 0,45 g | — | — | — | — | 73 | 51 |
| 70 (E) | VI-23 | 0,45 g | I-27 | 0,23 g | VP-3 | 0,23 g | 37 | 26 |
| 71 (E) | VI-23 | 0,45 g | I-27 | 0,23 g | III-7 | 0,23 g | 24 | 16 |
| 72 (E) | VI-23 | 0,45 g | I-27 | 0,23 g | V-7 | 0,23 g | 25 | 16 |
| 73 (E) | VI-23 | 0,45 g | I-36 | 0,23 g | II-10 | 0,23 g | 34 | 23 |
| 74 (E) | VI-23 | 0,45 g | I-36 | 0,23 g | V-9 | 0,23 g | 29 | 20 |
| 75 (E) | VI-23 | 0,45 g | I-36 | 0,23 g | SA-2 | 0,23 g | 30 | 20 |
| 76 (E) | VI-23 | 0,45 g | I-36 | 0,23 g | SA-9 | 0,23 g | 29 | 19 |
| 77 (E) | VI-23 | 0,45 g | I-36 | 0,23 g | SB-1 | 0,23 g | 32 | 22 |

Example 6 shows the improvement in light stability through use of formula I compounds (samples 61, 66, 70) and the further increase in efficiency by combination with light-excluding agents in the form of compounds having one of the formulae II, III, IV, V, SA and SB. The compounds VP-1, VP-3 used for comparison were considerably less efficient.

We claim:

1. A color photographic recording material comprising at least one red-sensitive silver halide emulsion layer having associated to it a cyan coupler, wherein said cyano coupler is present in the red-sensitive silver halide emulsion or in an adjacent binder layer, at least one green-sensitive silver halide emulsion layer having associated to it a magenta coupler, wherein said magenta coupler is present in the green-sensitive silver halide emulsion or in an adjacent binder layer, and at least one blue-sensitive silver halide emulsion layer having associated to it a yellow coupler, wherein said yellow coupler is present in the blue-sensitive silver halide emulsion or in an adjacent binder layer, the material containing a hydroquinone diether compound in at least one of said light-sensitive silver halide emulsion layers or at least one of said binder layers, characterised in that the hydroquinone diether compound corresponds to the following formula:

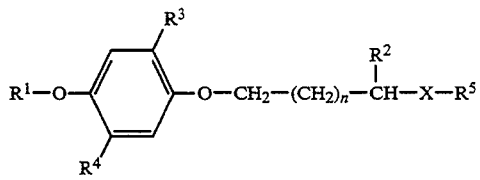

I wherein $R^1$ denotes alkyl, cycloalkyl or aryl, provided that said alkyl is not a propyl group having two or more substituents;

$R^2$ denotes H or alkyl;

$R^3$ and $R^4$ are the same or different and denote H, alkyl, cycloalkyl, aryl, halogen, alkoxy, aroxy, acyloxy, alkylthio, arylthio, acyl, sulphonyl, sulphamoyl, acylamino, sulphonylamino or nitro, provided that said alkoxy denoted by one of $R^3$ and $R^4$ is not a propoxy group having two or more substituents;

$R^5$ denotes H, acyl or alkyl;

X denotes —O— or —$NR^6$—;

$R^6$ denotes H or alkyl; and n denotes zero or an integer from 1 to 3, provided that when n denotes zero and X denotes —O— said alkyl denoted by $R^2$ is not —$CH_2OR^7$ wherein $R^7$ denotes H, alkyl, alkenyl, phenylalkyl, aryl, cycloalkyl, alkylcarbonyl, akenylcarbonyl or phenylcarbonyl.

2. A recording material as claimed in claim 1, wherein at least one of $R^3$ and $R^4$ in formula I stands for tertiary alkyl.

3. A recording material as claimed in claim 1 wherein in formula I —X—$R^5$ stands for —OH, —O—CH-$_2$—$CH_2$—OH or —O—acyl, the acyl radical being derived from an aliphatic or aromatic carboxylic acid, a carbamic acid, a carbonic monoester or from phosphorous acid.

4. A recording material as claimed in claim 1, wherein in formula I, the letter n stands for 0 or 1.

5. A recording material as claimed in claim 1, comprising in the same layer in combination with a hydroquinone diether compound of formula I, at least one compound having one of the formulae II, III, IV, V, SA or SB

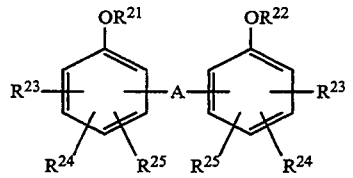

II wherein $R^{21}$ and $R^{22}$ are the same or different and denote H, acyl or alkyl, $R^{23}$, $R^{24}$ and $R^{25}$ are the same or different and denote $R^3$;

A denotes a single bond, —S(=O)$_m$—, alkylene or —$NR^{26}$—;

$R^{26}$ denotes alkyl or aryl;

m denotes 0, 1 or 2 wherein when A is not bonded to the para position to —$OR^{21}$ and —$OR^{22}$ a residue which is not releasable during chromogenic development selected from the group consisting of those represented by one of $R^{23}$, $R^{24}$ and $R^{25}$ is bonded to the para position;

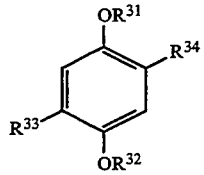

III wherein $R^{31}$ and $R^{32}$ are the same or different and stand for alkyl or cycloalkyl;

$R^{33}$ and $R^{34}$ are the same or different and stand for $R^3$;

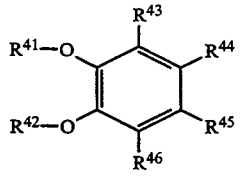

IV $R^{41}$ and $R^{42}$ are the same or different and stand for H, acyl or alkyl;

$R^{43}$, $R^{44}$, $R^{45}$ and $R^{46}$ are the same or different and stand for $R^3$, provided that at least one of $R^{44}$ and $R^{45}$ does not denote alkyl;

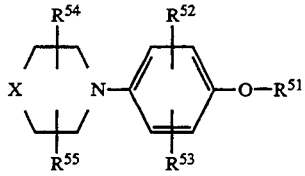

V in which $R^{51}$ denotes alkyl, cycloalkyl or aryl;

$R^{52}$, $R^{53}$, $R^{54}$ and $R^{55}$ are the same or different and denote $R^3$ and X denotes $$-\overset{R^{56}}{\overset{|}{C}}H-,\ -CO-,\ -O-,\ -S-,\ -SO-,\ SO_2-\ \text{or}\ -\overset{R^{57}}{\overset{|}{N}}-;$$

$R^{56}$ denotes the radical defined in $R^3$;

$R^{57}$ denotes alkyl, aryl, acyl or sulfonyl;

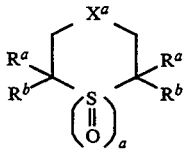

(SA)

wherein $R^a$ and $R^b$ are the same or different and denotes H, alkyl or aryl; a denotes 0, 1 or 2;

$X^a$ denotes a residue for completing a tetrahydrothiapyrane ring provided that $R^a$ and $R^b$ may complete a ring;

$$R^c—S—D—X^b—R^d \qquad \text{(SB)}$$

$R^c$ and $R^d$ are the same or different and denote alkyl or aryl

D denotes alkylene having 1 to 16 carbon atoms;

$X^b$ denotes —CO—O—, —O—CO—, —CO—NH— or —NH—CO—.

6. A recording material as claimed in claim 5, wherein in formula II, A stands for alkylene and $R^{21}$ and $R^{22}$ stand for H.

7. A recording material as claimed in claim 5, wherein in formula III, at least one of $R^{33}$ and $R^{34}$ stands for alkyl.

8. A recording material as claimed in claim 5, wherein in formula IV, at least one of $R^{43}$ and $R^{46}$ and/or at least one of $R^{44}$ and $R^{45}$ stand for H.

9. A recording material as claimed in claim 5, wherein in formula V, $R^{54}$ and $R^{55}$ stand for H.

10. A recording material as claimed claim 1, wherein at least one green-sensitive silver halide emulsion layer has associated to it a compound of formula I in combination with a magenta coupler of formula VI

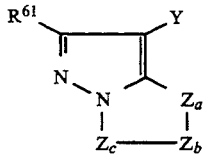

VI $R^{61}$ stands for H or a group which can be released by coupling $Z_a$, $Z_b$, $Z_c$ denote an unsubstituted substituted methine group, =N— or —NH— and either the bond $Z_z$—$Z_b$ or the bond $Z_b$—$Z_c$ is a double bond and the other bond is a single bond wherein said compound of formula VI is present in the green-sensitive silver halide emulsion or in an adjacent binder layer.

11. A recording material as claimed in claim 10, wherein the magenta coupler corresponds to one of the formulae VId and VIe

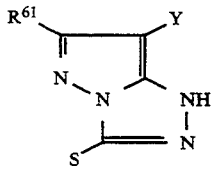

VId

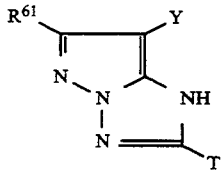

VIe in which $R^{61}$, S and T stand for hydrogen, alkyl, aralkyl, aryl, alkoxy, aroxy, alkylthio, arylthio, amino, anilino, acylamino, cyan, alkoxycarbonyl, carbamoyl or sulphamoyl, and at least one of $R^{61}$ and S (in formula VId) or at least one of $R^{61}$ and T (in formula VIe) denotes a secondary alkyl or tertiary alkyl, and Y stands for hydrogen or a radical which can be split off during dye coupling.

12. A recording material as claimed in claim 10, wherein the formula I compound or the combination of a formula I compound with at least one compound having one of the formulae II, III, IV, V, SA and SB is present in the proportion of 0.2 to 2 by weight relative to the formula VI magenta coupler in the green-sensitive silver halide emulsion layer.

13. The recording material according to claim 1, wherein the alkyl radical represented by $R^1$ to $R^6$ is straight-chain or branched, unsubstituted or substituted and contains up to 18 carbon atoms.

14. The recording material according to claim 13, wherein $R^1$ to $R^6$ are identical or different and unsubstituted or substituted with substituents and $R^1$ to $R^6$ are selected from the group consisting of methyl, ethyl, propyl, isopropyl, butyl, tert-butyl, tert-amyl, hexyl, tert-hexyl, octyl and dodecyl, and wherein said substituents are selected from the group consisting of halogen, hydroxy, alkoxy, alkoxycarbonyl and dialkylamino.

15. The recording material according to claim 12, wherein $R^1$, $R^3$ or $R^4$ are the same or different and are cyclohexyl, cyclopentyl, unsubstituted phenyl or phenyl substituted by alkylsulphonyl, alkyl alkoxy or both alkyl and alkoxy.

16. The recording material as claimed in claim 1, wherein $R^3$, $R^4$ or $R^5$ are the same or different and are selected from the group consisting of acetyl, 2-ethylhexanoyl, p-hydroxybenzoyl, N-n-butyl carbomoyl, N-t-butyl carbomoyl, N-dodecyl carbamoyl, hexyloxy carbonyl and dodecyloxy carbonyl.

17. The recording material according to claim 1, wherein at least one of $R^3$ and $R^4$ is tertiary alkyl or wherein n is 0 or 1.

18. The recording material according to claim 1, wherein the hydroquinone diether compound is selected from the group consisting of

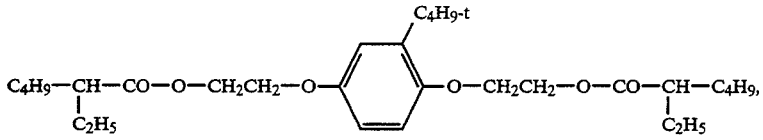

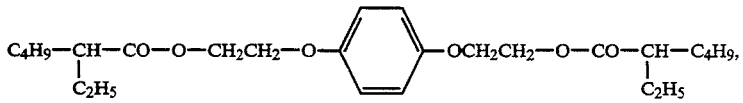

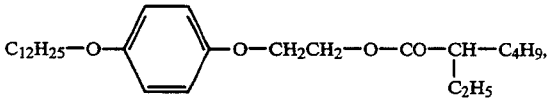

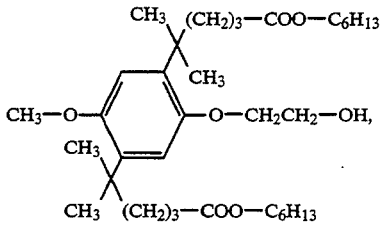

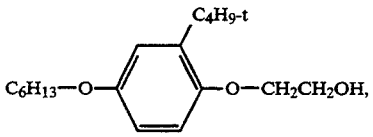

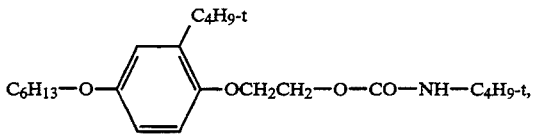

-continued
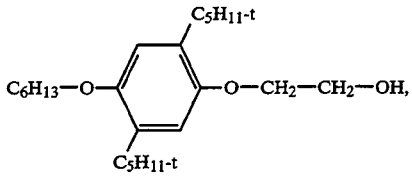
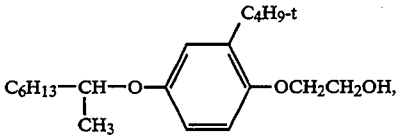
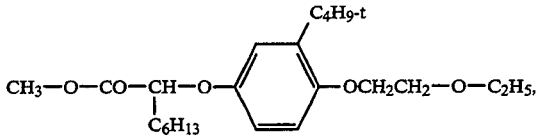
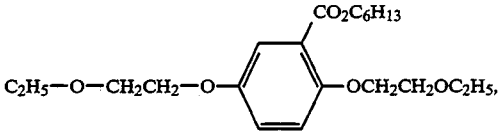
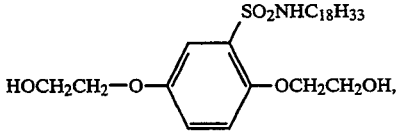
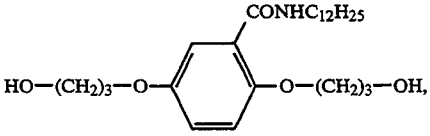
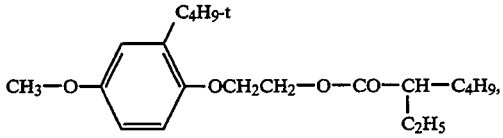
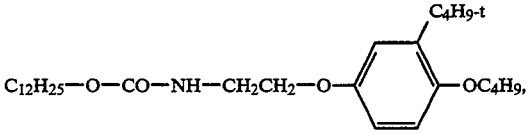
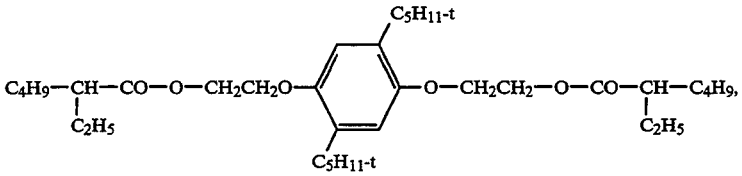
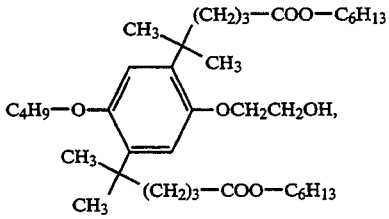
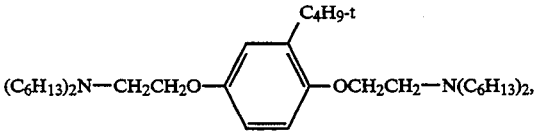
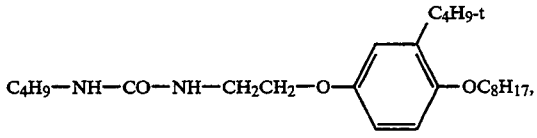
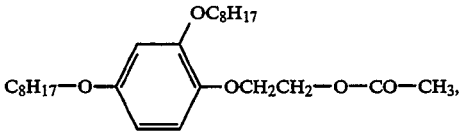
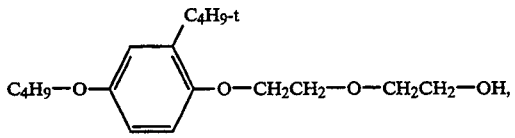
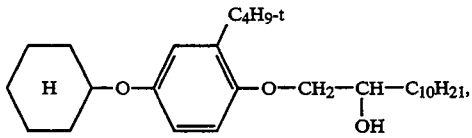
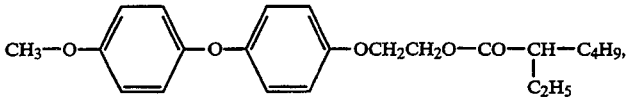
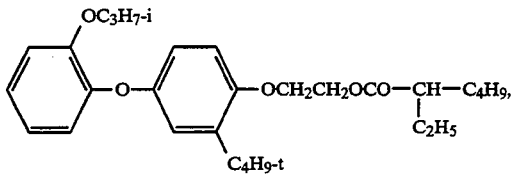

-continued
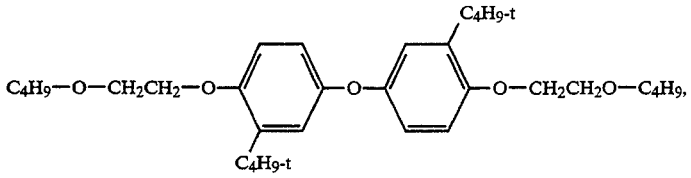
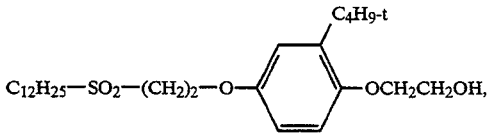
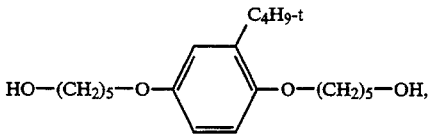
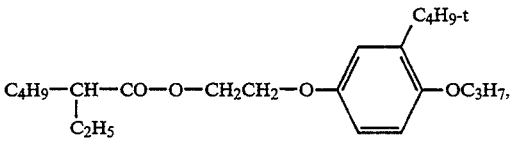
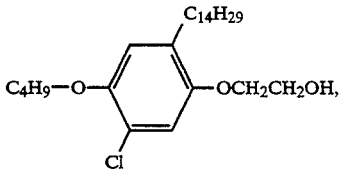
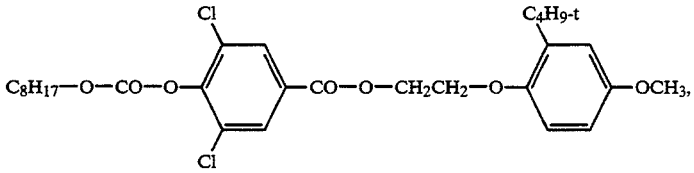
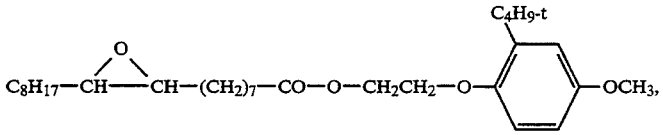
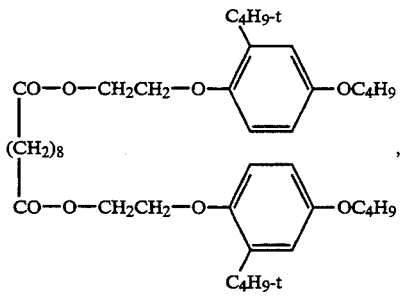
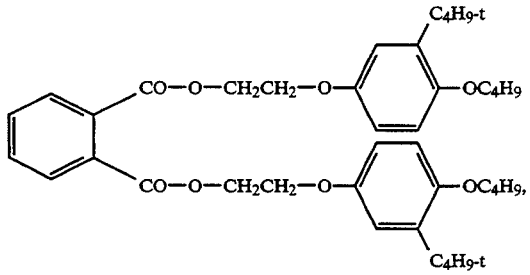
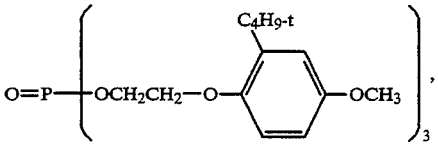

-continued

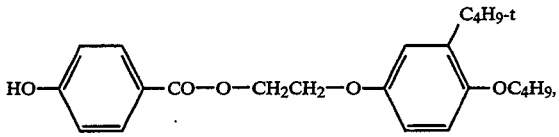

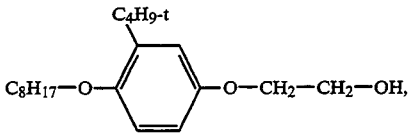

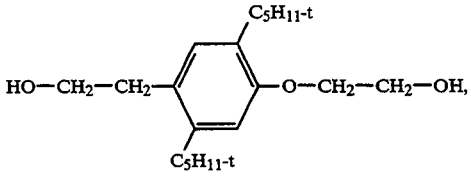

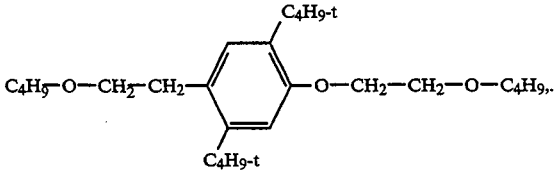

19. The recording material according to claim 5, wherein A is bonded to a position para- or ortho- to $OR^{21}$ and $OR^{22}$ and wherein D denotes an alkylene having from 1 to 12 carbon atoms and wherein $R^c$ and $R^d$ are the same or different and are an unsubstituted alkyl or an alkyl substituted with aryl, acyloxy, alkythio or alkoxycarbonyl.

20. The recording material according to claim 5, wherein A is an alkylene with 1 to 6 carbon atoms or $-S(=O)_m-$ with m is 0, 1 or 2;

$R^{21}$ and $R^{22}$ stand for hydrogen;

at least one of $R^{33}$ and $R^{34}$ stands or alkyl;

$R^{41}$ and $R^{42}$ are the same or different and stand for hydrogen or alkyl;

$R^{54}$ and $R^{55}$ stand for hydrogen.

21. The recording material as claimed in claim 5, wherein at least one compound is selected from the group consisting of

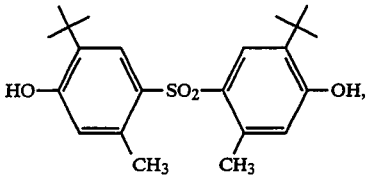

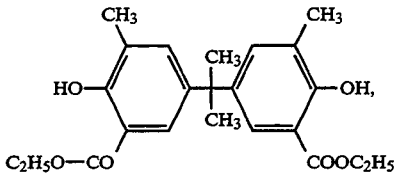

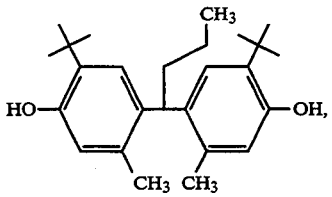

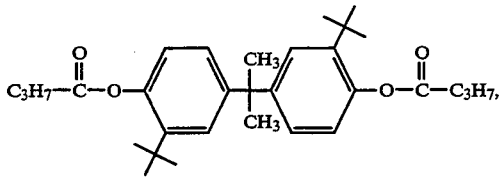

-continued

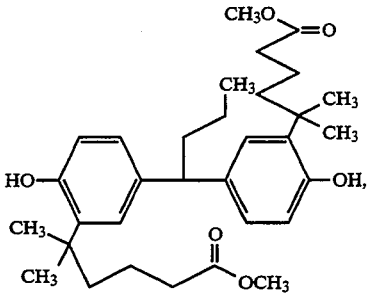

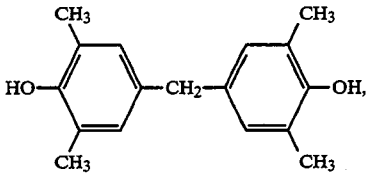

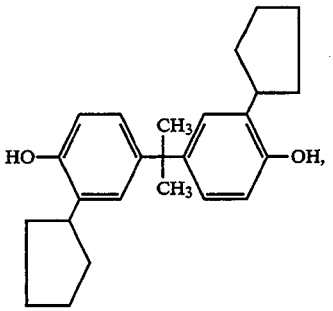

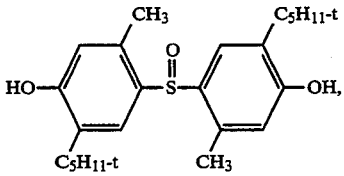

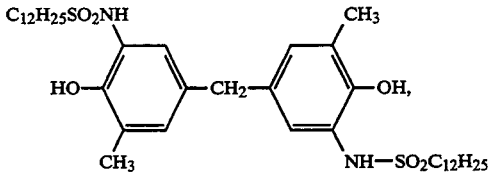

-continued
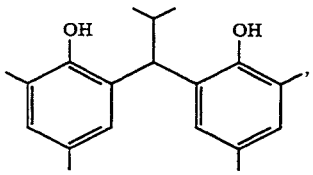
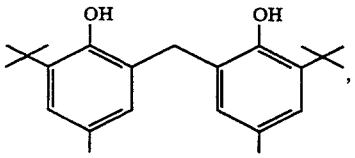
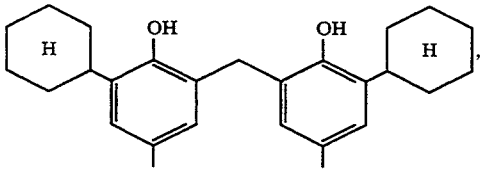
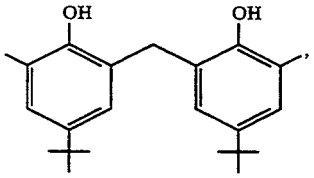
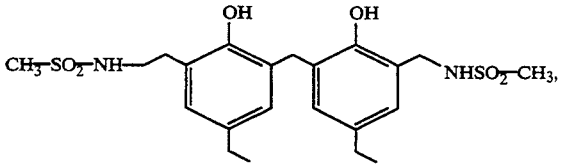
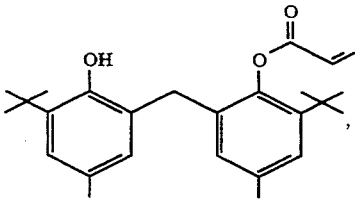
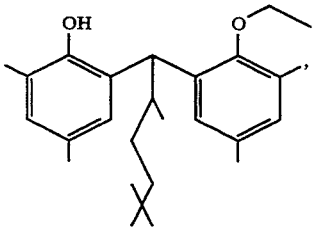
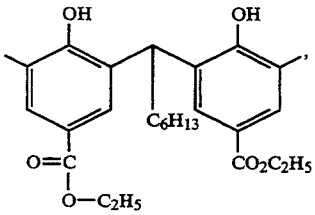
-continued
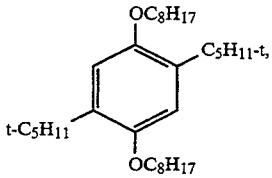
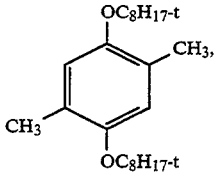
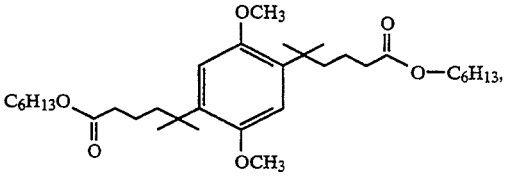
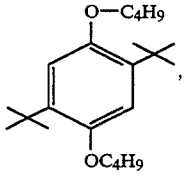
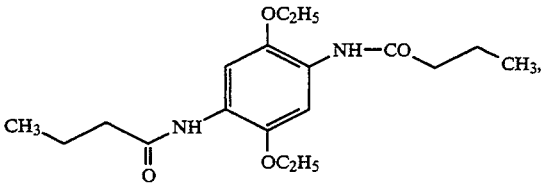
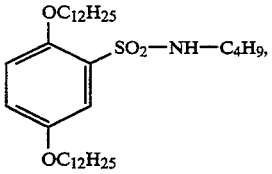
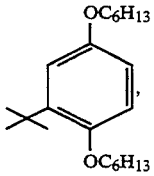
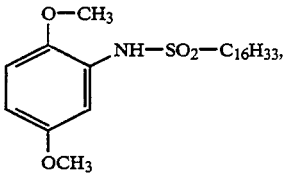
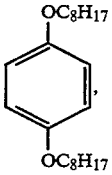

-continued
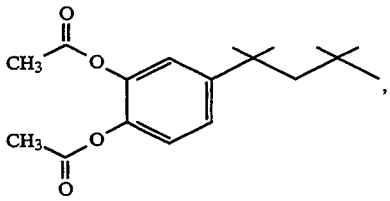
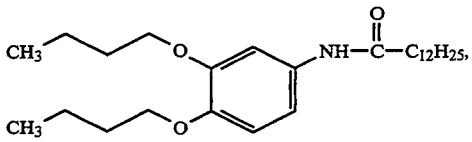
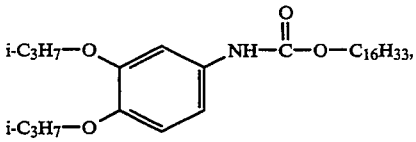
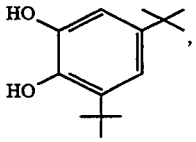
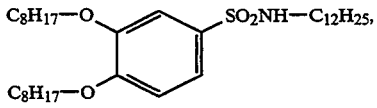
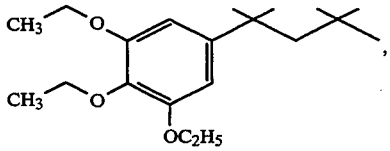
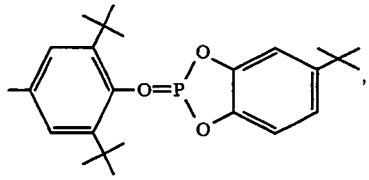
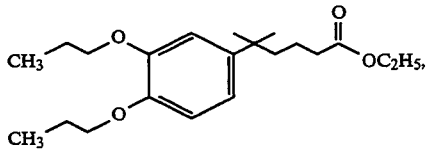
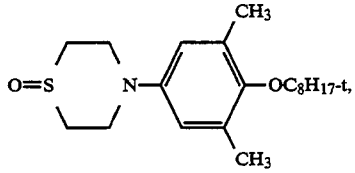
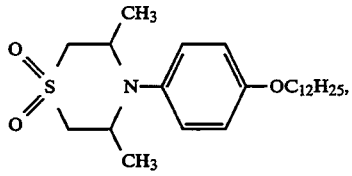
-continued
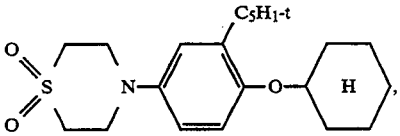
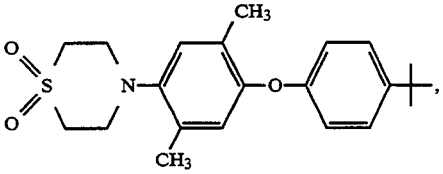
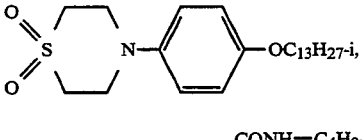
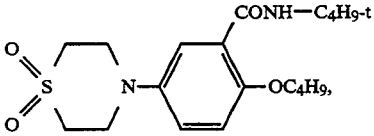
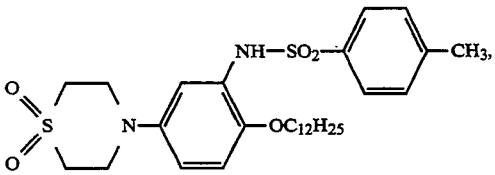
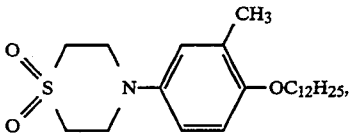
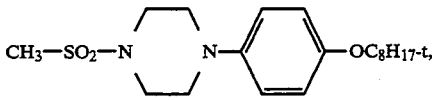
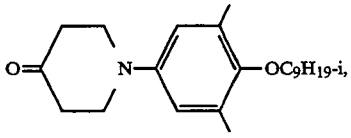
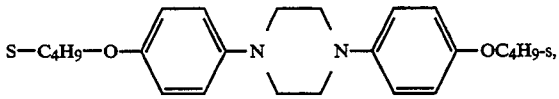
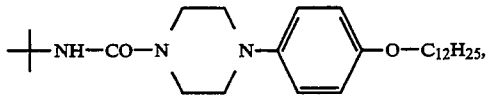
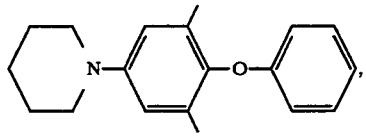

-continued
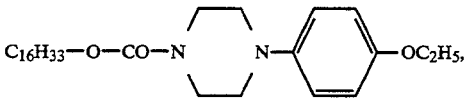
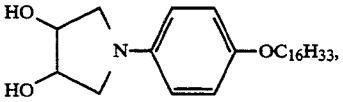
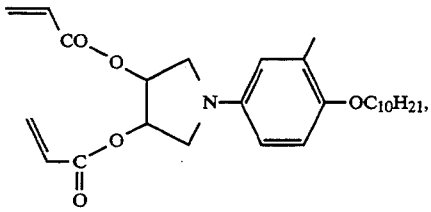
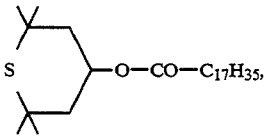
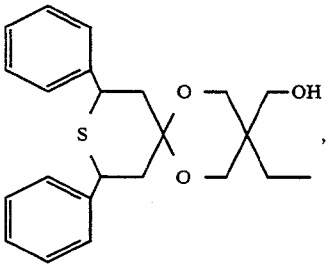
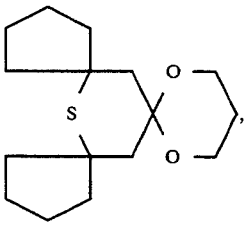
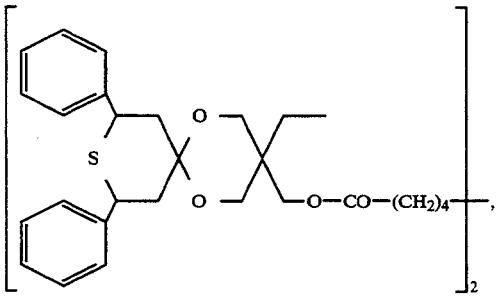
-continued
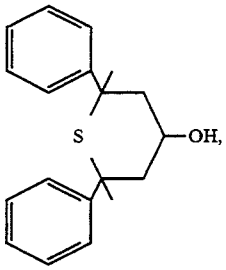
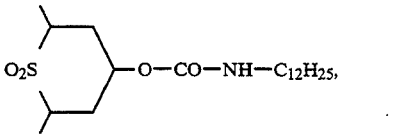
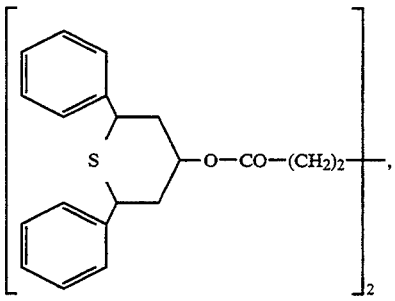
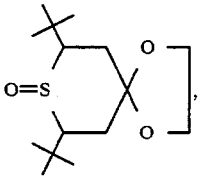
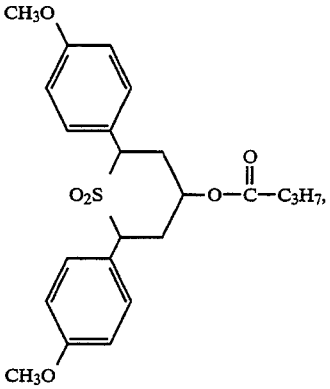
$S-(CH_2-CH_2-COO-C_{12}H_{25})_2$,
$CH_2(S-CH_2CH_2-COO-C_4H_9)_2$,
$(C_8H_{17}-S-CH_2CH_2-COO-CH_2)_4-C$,
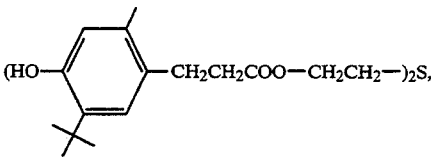
$C_4H_9-S-(CH_2)_4-COO-C_4H_9$ and
$S(CH_2CH_2COO-C_{14}H_{29})_2$.
22. The recording material as claimed in claim 5, wherein said compounds of formula I are used with compounds of the formulas II, III, IV, V, SA or SB in a proportion of 1:10 to 10:1.
* * * * *